US008232030B2

(12) United States Patent
Yu et al.

(10) Patent No.: US 8,232,030 B2
(45) **Date of Patent: *Jul. 31, 2012**

(54) CURL-FREE IMAGING MEMBERS WITH A SLIPPERY SURFACE

(75) Inventors: Robert C. U. Yu, Webster, NY (US); Yuhua Tong, Webster, NY (US); Stephen T. Avery, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 213 days.

This patent is subject to a terminal disclaimer.

(21) Appl. No.: 12/726,207

(22) Filed: Mar. 17, 2010

(65) Prior Publication Data

US 2011/0229808 A1 Sep. 22, 2011

(51) Int. Cl.
*G03G 5/00* (2006.01)

(52) U.S. Cl. ..... 430/58.05; 430/58.2; 399/159

(58) Field of Classification Search ..... 430/58.05, 430/58.2; 399/159

See application file for complete search history.

(56) References Cited

U.S. PATENT DOCUMENTS

| | | | |
|---|---|---|---|
| 3,121,006 | A | 2/1964 | Middleton et al. |
| 3,820,989 | A | 6/1974 | Rule et al. |
| 3,837,851 | A | 9/1974 | Shattuck et al. |
| 3,895,944 | A | 7/1975 | Wiedemann et al. |
| 4,150,987 | A | 4/1979 | Anderson et al. |
| 4,233,384 | A | 11/1980 | Turner et al. |
| 4,245,021 | A | 1/1981 | Kazami et al. |
| 4,256,821 | A | 3/1981 | Enomoto et al. |
| 4,265,990 | A | 5/1981 | Stolka et al. |
| 4,278,746 | A | 7/1981 | Goto et al. |
| 4,286,003 | A | 8/1981 | Higgins et al. |
| 4,291,110 | A | 9/1981 | Lee |
| 4,297,426 | A | 10/1981 | Sakai et al. |
| 4,299,897 | A | 11/1981 | Stolka et al. |
| 4,306,008 | A | 12/1981 | Pai et al. |
| 4,315,982 | A | 2/1982 | Ishikawa et al. |
| 4,338,387 | A | 7/1982 | Hewitt |
| 4,338,388 | A | 7/1982 | Sakai et al. |
| 4,385,106 | A | 5/1983 | Sakai |
| 4,387,147 | A | 6/1983 | Sakai |
| 4,399,207 | A | 8/1983 | Sakai et al. |
| 4,399,208 | A | 8/1983 | Takasu et al. |
| 4,439,507 | A | 3/1984 | Pan et al. |
| 4,587,189 | A | 5/1986 | Hor et al. |
| 4,664,995 | A | 5/1987 | Horgan et al. |
| 4,988,597 | A | 1/1991 | Spiewak et al. |
| 5,069,993 | A | 12/1991 | Robinette et al. |
| 5,096,795 | A | 3/1992 | Yu |
| 5,244,762 | A | 9/1993 | Spiewak et al. |
| 5,697,024 | A | 12/1997 | Mishra |
| 5,703,487 | A | 12/1997 | Mishra |

(Continued)

OTHER PUBLICATIONS

U.S. Appl. No. 12/712,064, filed Feb. 24, 2010, entitled "Slippery Surface Imaging Members," inventors, Yu, et al.

(Continued)

*Primary Examiner* — Mark A Chapman

(74) *Attorney, Agent, or Firm* — Pillsbury Winthrop Shaw Pittman LLP

(57) ABSTRACT

Present embodiments are directed to the improvement of flexible imaging members used in electrophotography. More particularly, embodiments pertain to a structurally simplified curl-free flexible electrophotographic imaging member without the need for an anticurl back coating, having a functionally improved top outermost exposed slippery imaging layer which furthers extends service life, and provides a process for making and using the member.

24 Claims, 5 Drawing Sheets

U.S. PATENT DOCUMENTS

| | | | | |
|---|---|---|---|---|
| 5,756,245 | A | 5/1998 | Esteghamatian et al. | |
| 5,830,614 | A | 11/1998 | Pai et al. | |
| 6,008,653 | A | 12/1999 | Popovic et al. | |
| 6,117,603 | A | 9/2000 | Yu et al. | |
| 6,119,536 | A | 9/2000 | Popovic et al. | |
| 6,124,514 | A | 9/2000 | Emmrich et al. | |
| 6,150,824 | A | 11/2000 | Mishra et al. | |
| 6,214,514 | B1 | 4/2001 | Evans et al. | |
| 6,326,111 | B1 | 12/2001 | Chambers et al. | |
| 6,337,166 | B1 | 1/2002 | Chambers et al. | |
| 6,756,169 | B2 | 6/2004 | Lin et al. | |
| 6,933,089 | B2 | 8/2005 | Horgan et al. | |
| 7,018,756 | B2 | 3/2006 | Pai et al. | |
| 7,033,714 | B2 | 4/2006 | Horgan et al. | |
| 7,422,831 | B2 * | 9/2008 | Yu | 430/69 |
| 7,504,187 | B2 * | 3/2009 | Yu et al. | 430/69 |
| 7,611,811 | B2 | 11/2009 | Yu et al. | |
| 2009/0253058 | A1 * | 10/2009 | Yu et al. | 430/58.8 |
| 2009/0253059 | A1 * | 10/2009 | Yu et al. | 430/58.8 |

OTHER PUBLICATIONS

U.S. Appl. No. 12/434,572, filed May 1, 2009, entitled "Flexible Imaging Members Without Anticurl Layer," inventors, Yu, et al.

U.S. Appl. No. 12/476,200, filed Jun. 1, 2009, entitled "Crack Resistant Imaging Member Preparation and Processing Method," inventors, Yu, et al.

U.S. Appl. No. 12/471,311, filed May 22, 2009, entitled "Flexible Imaging Members Having a Plasticized Imaging Layer," inventors, Yu, et al.

U.S. Appl. No. 12/551,440, filed Aug. 31, 2009, entitled "Flexible Imaging Member Belts," inventors, Yu, et al.

U.S. Appl. No. 12/551,414, filed Aug. 31, 2009, entitled "Flexible Imaging Member Belts," inventors, Yu, et al.

* cited by examiner

CURL-FREE IMAGING MEMBERS WITH A SLIPPERY SURFACE

BACKGROUND

The presently disclosed embodiments are directed to the improvement of flexible imaging members used in electrophotography. These embodiments are, more particularly, pertaining to a structurally simplified curl-free flexible electrophotographic imaging member without the need for an anticurl back coating, having a functionally improved top outermost exposed slippery imaging layer which furthers extends service life, and provides a process for making and using the member. More specifically, the present disclosure relates to all types of flexible electrophotographic imaging member belts used in electrophotography.

Electrophotographic imaging members are known in the art. Typical electrophotographic imaging members include (1) electrophotographic imaging members or photoreceptors for electrophotographic imaging systems and (2) electroreceptors such as ionographic imaging members for electrographic imaging systems. Generally, these imaging members comprise at least a supporting substrate and at least one imaging layer comprising a thermoplastic polymeric matrix material. In a photoreceptor, the photoconductive imaging layer may comprise only a single photoconductive layer or multiple of layers such as a combination of a charge generating layer and one or more charge transport layer(s). In an electroreceptor, the imaging layer is a dielectric imaging layer. Electrophotographic imaging members can have a number of distinctively different configurations. For example, they can comprise a flexible member, such as a flexible scroll or a belt containing a flexible substrate. Since typical flexible electrophotographic imaging members exhibit upward imaging member curling after completion of the outermost exposed imaging layer, an anticurl back coating layer is applied to the back side of the flexible substrate support to counteract/balance the curl and provide the desirable imaging member flatness.

Alternatively, the electrophotographic imaging member can also be a rigid member, such as those utilizing a rigid substrate drum. For these drum imaging members, having a thick rigid cylindrical supporting substrate bearing one or more imaging layers, they do not exhibit imaging member curl-up problem, and thus, do not require an anti-curl back coating layer. Consequently, these are not included in the scope of this disclosure.

In the present disclosure, methodology and material reformulations pertaining to structurally simplified flexible electrophotographic imaging member without the need for an anti-curl back coating, having a functionally improved outermost exposed slippery imaging layer which provides an extended useful service-life function, and a process for making and using the member are specified and equality applicable for flexible imaging members in all varieties of form. However, for reason of simplicity, all the disclosed embodiments detailed hereinafter are focused and represented primarily on the electrophotographic imaging members in flexible seamed belt configuration which are for use in electrophotography.

A number of current flexible electrophotographic imaging members are multilayered photoreceptor belts that, in a negative charging system, comprise a substrate support, an electrically conductive layer, an optional charge blocking layer, an optional adhesive layer, a charge generating layer (CGL), a charge transport layer (CTL), and an optional anti-curl back coating at the opposite side of the substrate support. In such an electrophotographic imaging member design, the CTL is the top outermost layer and is exposed to the environment. The typical flexible electrophotographic imaging members do always exhibit upward curling after completing the application process of a CTL, an anticurl back coating (ACBC) is usually employed on the back side of the flexible substrate support (the side opposite from the electrically active layers) to balance/control the curl and render the imaging member with desired flatness. So, the ACBC is the bottom outermost exposed layer of the imaging member.

The flexible electrophotographic imaging members are typically prepared in a seamed or seamless belt configuration. Flexible electrophotographic imaging member seamed belts are typically fabricated from a sheet which is cut from a web. The sheets are generally rectangular in shape. The edges may be of the same length or one pair of parallel edges may be longer than the other pair of parallel edges. The sheets are formed into a belt by joining overlapping opposite marginal end regions of the sheet. A seam is typically produced in the overlapping marginal end regions at the point of joining. Joining may be effected by any suitable means. Typical joining techniques include welding (including ultrasonic), gluing, taping, pressure heat fusing, and the like. Ultrasonic welding is generally the more desirable method of joining because it is rapid, clean (no solvents) and produces a thin and narrow seam. In addition, ultrasonic welding is more desirable because it causes generation of heat at the contiguous overlapping end marginal regions of the sheet to maximize melting of one or more layers therein to produce a strong fusion bonded seam.

In a typical negative charging machine design, the prepared flexible imaging member seamed belt is mounted over and encircled around a belt support module comprising numbers of belt support rollers and backer bars ready for electrophotographic imaging function. The flexible electrophotographic imaging member seamed belt is imaged by uniformly depositing an electrostatic charge on the imaging surface of the electrophotographic imaging member and then exposing the imaging member to a pattern of activating electromagnetic radiation, such as light, which selectively dissipates the charge in the illuminated areas of the imaging member while leaving behind an electrostatic latent image in the non-illuminated areas. This electrostatic latent image may then be developed to form a visible image by depositing finely divided electroscopic marking toner particles on the imaging member surface. The resulting visible toner image can then be transferred to a suitable receiving member or substrate such as paper. Therefore, under these normal machine operation conditions in the field, the flexible imaging member seamed belt is in dynamic fatigued cyclic motion during electrophotographic image printing processes. The top outermost exposed CTL of the imaging member belt is therefore constantly in intimate mechanical (such as for example cleaning blade, tab blade, cleaning brush, etc.) and chemical (such as corona effluents from charging devices) interactions with various machine subsystems and components to fatigue and degrade the CTL. These interactions have been seen to degrade and exacerbate the early development of two crucial CTL material failures in the belt, causing copy printout defects to premature cut short its service life prior to reaching the intended belt life target. Moreover, under the machine imaging member belt functioning conditions, the bottom outermost exposed the ACBC is constantly subjected to belt support rollers and backer bars mechanical interactions which thereby promoting on-set of premature ACBC wear and abrasion streaking failures.

Therefore, the cause of material failures associated with the conventional prior art flexible imaging member seamed belts can be identified from two origins and are listed in the following description.

Onset of Charge Transport Layer Failure

Since the top charge transport layer (CTL) of the imaging member belt is the outermost exposed layer, it is contacting and engaged to all electrophotographic imaging subsystems interactions. That means the top exposed CTL surface of the flexible imaging member belt is constantly subjected to physical/mechanical/electrical/chemical species interactions such as the mechanical sliding actions of cleaning blade and cleaning brush, electrical charging devices, corona effluents exposure, developer components, image formation toner particles, hard carrier particles, receiving paper, and the like during dynamic belt cyclic motion. These interactions, particularly the friction force arisen by the sliding action of cleaning blade/brush/tab blade, against the surface of the CTL have been found to cause surface scratching, abrasion, and rapid CTL surface wear; in some instances, the CTL wears away by as much as 10 micrometers after approximately 20,000 dynamic belt imaging cycles. Excessive CTL wear is a serious problem because it causes significant change in the charged field potential and adversely impacts copy printout quality. Another consequence of CTL wear is the decrease of CTL thickness which alters the equilibrium of the balancing forces between the CTL and the ACBC and impacts imaging member belt flatness. The reduction of the CTL by wear causes the imaging member belt to curl downward at both edges. Edge curling in the belt is an important issue because it changes the distance between the belt surface and the charging device(s), causing non-uniform surface charging density which manifests itself as a "smile" print defects on print-out paper copies. Such a print defect is characterized by lower intensity of print-images at the locations over both belt edges. The susceptibility of the CTL surface to scratches (caused by interaction against developer carrier beads and hard particulate from paper debris) has also been identified as a major imaging member functional failure since the scratches manifest themselves as print defects.

To provide desirable photo-electrical activity function, the current CTL (having a high surface energy of about 39 dynes/cm) is formulated with material compositions that are needed to give proper xerographic function. The high surface energy CTL is therefore prone to collect toner residues, dirt/debris particles, and additives from receiving papers. The eventual fusion of these collected species causes the formation of comets and filming over the outer surface of the CTL, further degrading the image quality of printouts. Another problem associated with high CTL surface energy is that it produces high sliding contact friction against the cleaning blade, tab blade, and cleaning brush mechanical action to exacerbate abrasion and wear failures. Moreover, since high CTL surface energy does also impede absolute toner image transfer from imaging member surface to the receiving paper, it is therefore impacting the image quality of printout copies.

Moreover, the need for an ACBC to control the imaging member upward curling and render belt flatness not only does significantly add the imaging member production cost, it has also been found to introduce a set of serious mechanical problems.

Anticurl Back Coating Mechanical Failure

Typical negatively-charged electrophotographic imaging member belts, such as the flexible multiple layered photoreceptor belt designs, are composite made of multiple layers comprising a flexible supporting substrate, a conductive ground plane, a charge blocking layer, an optional adhesive layer, a charge generating layer (CGL), a charge transport layer (CTL), and a curl control anticurl back coating (ACBC). The CTL is usually the top outermost layer to be coated over the CGL and is applied by solution coating then subsequently followed by drying the wet applied CTL coating at elevated temperatures of about 120° C., and finally cooling down the coated photoreceptor to the ambient room temperature of about 25° C. Therefore, when a production web stock of several thousand feet of coated multilayered photoreceptor material is obtained after finishing solution application of the CTL coating and through drying/cooling process, if unrestrained, spontaneous upward curling of the multilayered photoreceptor does occur. This upward curling is a consequence of thermal contraction mismatch between the CTL and the substrate support. Since the CTL in a typical photoreceptor device has a coefficient of thermal contraction approximately 3.7 times greater than that of the flexible substrate support, the CTL does therefore have a larger dimensional shrinkage than that of the flexible substrate support after the eventual photoreceptor web stock cools down to the ambient room temperature. The exhibition of photoreceptor web stock curling up after completion of CTL coating is due to the consequence of the heating/cooling cycles and processing step. Development of the upward curling can be explained by these mechanism: (1) as the web stock carrying the wet applied charge transport layer is dried at elevated temperature, dimensional contraction does occur when the wet CTL coating is losing its solvent during 120° C. elevated temperature drying, but at 120° C. the CTL remains as a viscous flowing liquid after losing its solvent. Since its glass transition temperature (Tg) is at 85° C., the CTL after losing of solvent will flow to re-adjust itself, release internal stress, and maintain its dimension stability; (2) as the CTL now in the viscous liquid state is cooling down further and reaching its glass transition temperature (Tg) at 85° C., the CTL instantaneously solidifies and adheres to the CGL below because it has then transformed itself from being a viscous liquid into a solid layer at its Tg; and (3) eventual cooling down the solid CTL of the photoreceptor web, from 85° C. down to the 25° C. room ambient, will then cause the CTL to contract more than the flexible substrate support since it has about 3.7 times greater thermal coefficient of dimensional contraction than that of the substrate support. This differential in dimensional contraction results in tension strain built-up in the CTL which therefore, at this instant, pulls the photoreceptor web upwardly to exhibit curling. If unrestrained at this point, the photoreceptor web stock will spontaneously curl-up into a 1½-inch roll. To offset the curling, an ACBC is applied to the backside of the flexible substrate support, opposite to the side having the CTL, and render the photoreceptor web stock with desired flatness.

Curling of an electrophotographic imaging member web is undesirable because it hinders fabrication of the web into cut sheets and subsequent welding into a seamed belt. So, to provide desirable flatness, an ACBC, having an equal counter curling effect but in the opposite direction to the applied CTL, is therefore needed at the reverse or back side of substrate support of the imaging member web to provide force balance and control the curl due to the dimensional shrinkage differential caused by mismatch of the thermal contraction coefficient between the substrate and the CTL, resulting in greater CTL dimensional shrinkage/contraction than that of the substrate after the heating/cooling processes of the applied CTL coating. Even though the application of an ACBC is effective to counteract and eliminate the curl, nonetheless the prepared flat imaging member web does have CTL tension stress build-up in it, creating an internal strain of about 0.27% in the layer. The impact of this internal strain build-up in the CTL is very undesirable, because it is additive to the induced bending strain of an imaging member belt as the belt bends and flexes over each belt support roller during dynamic fatigue belt cyclic motion under a normal machine electrophotographic imaging function condition in the field. The summation of the internal strain and the cumulative fatigue bending strain sustained in the CTL has been found to exacerbate the early onset of CTL cracking, preventing the belt to reach its targeted functional imaging life. Moreover, flexible imaging member belt employing an ACBC has added total belt thickness to thereby increase CTL bending strain which then exacerbates the early onset of belt cycling fatigue CTL cracking failure.

The cracks formed in the CTL from the consequence of dynamic belt fatiguing are found to manifest themselves into copy print-out defects, which thereby adversely affect the image quality printout on the receiving paper.

In addition to the abovementioned CTL shortfalls in flexible imaging member belt, various belt function deficiencies have also been observed in the common ACBC formulations used in a typical conventional imaging member belt, such as for example, the ACBC does not always providing satisfying dynamic imaging member belt performance result under a normal machine functioning condition; for example, exhibition of ACBC wear and its propensity to cause electrostatic charging-up are the frequently seen problems to prematurely cut short the service life of the imaging member belt, so it requires frequent costly belt replacement in the field. The ACBC wear under the normal imaging member belt machine operational conditions reduces the ACBC thickness, causing the lost of its ability to fully counteract the curl effect as reflected in exhibition of gradual imaging member belt curl up in relationship that depends on the time of belt function in the field. Curling is undesirable during imaging belt function because different segments of the imaging surface of the photoconductive member are located at different distances from charging devices, causing non-uniform charging. In addition, developer applicators and the like, during the electrophotographic imaging process, may all adversely affect the quality of the ultimate developed images. For example, non-uniform charging distances can manifest as variations in high background deposits during development of electrostatic latent images near the edges of paper. Since the ACBC is the bottom outermost exposed backing layer and has high surface contact friction as it slides over the machine subsystems of belt support module, such as rollers, stationary belt guiding components, and backer bars, during dynamic belt cyclic function, these mechanical sliding interactions against the belt support module components not only exacerbate ACBC wear/scratch/streak problems, it does also cause the relatively rapid wearing away of the ACBC to produce debris which scatters and deposits on critical machine components such as lenses, corona charging devices and the like, thereby adversely affecting machine performance. Moreover, ACBC abrasion/scratch/streak damage does also produce unbalance forces generation between the charge transport layer and the ACBC to cause micro belt ripples formation during electrophotographic imaging processes, resulting in bands of streak line print defects in output copies to deleteriously impact image printout quality and shorten the imaging member belt functional life.

High contact friction of the ACBC against machine subsystems is further seen to cause the development of electrostatic charge built-up problem. In other machines the electrostatic charge builds up due to contact friction between the ACBC and the backer bars increases the friction and thus requires higher torque to pull the belts. In full color machines with 10 pitches this can be extremely high due to large number of backer bars used. At times, one has to use two drive rollers rather than one which are to be coordinated electronically precisely to keep any possibility of sagging. Static charge built-up in the ACBC increases belt drive torque, in some instances, has also been found to result in absolute belt stalling. In other cases, the electrostatic charge build up can be so high as to cause sparking.

Another problem encountered in the conventional belt photoreceptors using a bisphenol A polycarbonate ACBC that are extensively cycled in precision electrophotographic imaging machines utilizing belt supporting backer bars, is an audible squeaky sound generated due to high contact friction interaction between the ACBC and the backer bars. Further, cumulative deposition of ACBC wear debris onto the backer bars may give rise to undesirable defect print marks formed on copies because each debris deposit become a surface protrusion point on the backer bar and locally forces the imaging member belt upwardly to interferes with the toner image development process. On other occasions, the ACBC wear debris accumulation on the backer bars does gradually increase the dynamic contact friction between these two interacting surfaces of ACBC and backer bar, interfering with the duty cycle of the driving motor to a point where the motor eventually stalls and belt cycling prematurely ceases. Additionally, it is also important to point out that an electrophotographic imaging member belts prepared that required ACBC to provide flatness has produced more than the above listed problems, the application of an ACBC does further incur additional material and labor cost impact to the current imaging member production process.

Thus, the conventional prior art flexible electrophotographic imaging member seamed belts comprising a supporting substrate (having a conductive surface on one side, coated over with at least one photoconductive layer (such as having the top outermost exposed CTL) and coated on the other side of the supporting substrate with a conventional ACBC), do have inherent physical/mechanical deficiencies and limits which are undesirable in advanced automatic, cyclic electrophotographic imaging copiers, duplicators, and printers. While the above mentioned electrophotographic imaging member belts may be suitable or partially satisfactory for their intended purposes, further improvement on these imaging member belts are needed. For example, there continues to have the need for improvements in such systems, particularly for an imaging member belt that has: (a) a CTL with reduction of surface contacting friction, superb wear resistance, and lubricity to suppress wear as well as enhancing toner image transfer efficiency, and (b) sufficiently flatness without the need for an ACBC to reduce torque for ease of belt drive, nil or no wear debris generation, as well as elimination of electrostatic charge build-up problem, even for imaging member belt functioning in larger printing apparatuses. With so many of these above mentioned shortcomings and problems associated with the conventional electrophotographic imaging member belts now understood, therefore development of new/improved material reformulation and a methodology for fabricating imaging member belts that produce robust mechanical function and meet the future machine imaging member belt life extension requirement free of issues has been pursued. In the present disclosure, a low surface energy and internal stress/strain relieved CTL material reformulation method and process of making a flexible imaging member belt free of all the above mentioned deficiencies have been successfully identified and demonstrated through the creation of ACBC-free imaging member.

In summary, there is an urgent need for preparation of improved flexible imaging members having robust CTL reformulation which exhibits little or non of the abovementioned shortfalls and provide good abrasion/wear/filming resistances, surface slipperiness/lubricity, and mechanical durability. Furthermore, the improved imaging member shall also be a curl-free design without the need for an ACBC. In essence, such imaging members redesigned according to the present disclosure shall effect physical/mechanical function enhancements to significantly impact the imaging members' service life extension in the field. Additionally, the flexible imaging members thus prepared to have these improvements are also required to provide effective production cost cutting benefit.

The successful preparation of low surface energy/slippery CTL and curl-free imaging member belt, without an ACBC, does suppress abrasion/wear failure, no tribo-electrical charging, and extend the CTL service life will thereby be described in detailed embodiments hereinafter.

The following patents, the disclosure of which are incorporated in their entireties by reference, are mentioned for background information.

U.S. application Ser. Nos. 12/712,064, 12/434,572, 12/476,200, 12/471,311, 12/551,440, 12/551,414 disclose electrophotographic imaging members having a functionally improved top outermost exposed slippery imaging layer.

U.S. Pat. No. 7,611,811 discloses a negatively charged electrophotographic imaging member comprising a flexible supporting substrate with an electrically conductive outer surface, a CGL, and at least a one outermost exposed CTL layer comprises of a polycarbonate binder, a charge transport compound, and a low surface energy film forming polymer containing short chain polysiloxane segments in its backbone. The prepared imaging member has low surface energy surface, reduced surface contact friction, and improved surface lubricity.

U.S. Pat. No. 6,117,603 discloses an electrophotographic imaging member including a supporting substrate having an electrically conductive outer surface and at least a one layer having an exposed imaging surface, the CTL, including a continuous matrix comprising a film forming polymer and a surface energy lowering liquid polysiloxane.

U.S. Pat. No. 6,326,111 relates to a charge transport material for a photoreceptor including at least a polycarbonate polymer, at least one charge transport material, polytetrafluoroethylene (PTFE) particle aggregates having an average size of less than about 1.5 microns, hydrophobic silica and a fluorine-containing polymeric surfactant dispersed in a solvent. The presence of the hydrophobic silica enables the dispersion to have superior stability by preventing settling of the PTFE particles. A resulting CTL produced from the dispersion exhibits excellent wear resistance against contact with an AC bias charging roll, excellent electrical performance, and delivers superior print quality.

U.S. Pat. No. 6,337,166 discloses a charge transport material for a photoreceptor including at least a polycarbonate polymer binder having a number average molecular weight of not less than 35,000, at least one charge transport material, polytetrafluoroethylene (PTFE) particle aggregates having an average size of less than about 1.5 microns, and a fluorine-containing polymeric surfactant dispersed in a solvent mixture of at least tetrahydrofuran and toluene. The dispersion is able to form a uniform and stable material ideal for use in forming a CTL of a photoreceptor. The resulting CTL exhibits excellent wear resistance against contact with an AC bias charging roll, excellent electrical performance, and delivers superior print quality.

U.S. Pat. No. 4,265,990 illustrates a layered photoreceptor having a separate charge generating layer and a separate CTL. The charge generating layer is capable of photogenerating holes and injecting the photogenerated holes into the CTL. The photogenerating layer utilized in multilayered photoreceptors includes, for example, inorganic photoconductive particles or organic photoconductive particles dispersed in a film forming polymeric binder. Examples of photosensitive members having at least two electrically operative layers including a charge generating layer and a diamine containing transport layer are disclosed in U.S. Pat. Nos. 4,233,384; 4,306,008; 4,299,897; and, 4,439,507, the disclosures of each of these patents being totally incorporated herein by reference in their entirety.

U.S. Pat. No. 5,096,795 discloses the preparation of a multilayered photoreceptor containing particulate materials for the exposed layers in which the particles are homogeneously dispersed therein. The particles reduce the coefficient of surface contact friction, increase wear resistance and durability against tensile cracking, and improve adhesion of the layers without adversely affecting the optical and electrical properties of the resulting photoreceptor.

In U.S. Pat. No. 5,069,993 issued to Robinette et al on Dec. 3, 1991, an exposed layer in an electrophotographic imaging member is provided with increased resistance to stress cracking and reduced coefficient of surface friction, without adverse effects on optical clarity and electrical performance. The layer contains a polymethylsiloxane copolymer and an inactive film forming resin binder.

U.S. Pat. No. 5,830,614 relates to a charge transport having two layers for use in a multilayer photoreceptor. The photoreceptor comprises a support layer, a charge generating layer, and two CTLs. The CTLs consist of a first transport layer comprising a charge transporting polymer (consisting of a polymer segment in direct linkage to a charge transporting segment) and a second transport layer comprising a same charge transporting polymer except that it has a lower weight percent of charge transporting segment than that of the first CTL. In the '614 patent, the hole transport compound is connected to the polymer backbone to create a single giant molecule of hole transporting polymer.

Although the prior arts of all the above electrophotographic imaging members disclosures comprising a flexible supporting substrate, a conductive surface on one side, coated over with at least one photoconductive layer (such as the outermost CTL), and coated on the other side of the supporting substrate with an ACBC have offer some degree of improvements, but do still exhibit deficiencies which are undesirable in advanced automatic, cyclic electrophotographic imaging copiers, duplicators, and printers.

While the above mentioned electrophotographic imaging members may be suitable or limited for their intended purposes, further improvement on these imaging members are definitively required. For example, there continues to be the need for improvements in such systems, particularly for an imaging member belt that does provide reduction in CTL surface contact friction to suppress/minimize wear, imparts lubricity/slipperiness to ease cleanly, minimizes wear debris build-up, and enhances toner image transfer efficiency to receiving papers with improved image copy print-out quality in printing apparatuses and xerographic machines. In the present disclosure, a CTL reformulated by plasticizing the layer and plus the inclusion of a selected low surface energy polymer has been successfully demonstrated. In brief, this is achieved through the inclusion of a novel low surface energy bisphenol A polycarbonate binder to impart CTL surface lubrication with the incorporation of a plasticizing liquid to relieve the CTL internal stress/strain build-up such that the resulting imaging member exhibits little or no upward curling without the need for an ACBC. Therefore, the prepared flexible imaging member has provided surface slipperiness to effect contact friction reduction, abhesiveness for toner image paper transfer efficiency enhancement, and is also curl-free without the application of an ACBC to impact imaging member belt production cost reduction.

SUMMARY

According to aspects illustrated herein, there is provided a flexible imaging member comprising: a flexible substrate, a charge generating layer disposed on the substrate, and at least one charge transport layer disposed on the charge generating layer, wherein the charge transport layer comprises a charge transport component molecularly dispersed in a low surface energy polycarbonate binder and at least one plasticizer, the low surface energy polymer binder being an A-B di-block copolymer comprising two segmental blocks, the first segment block (A) being

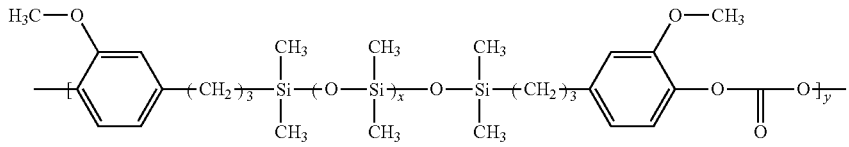

wherein x is 10 to 70, y is 1 to 15, and the second segment block (B) being selected from the group consisting of

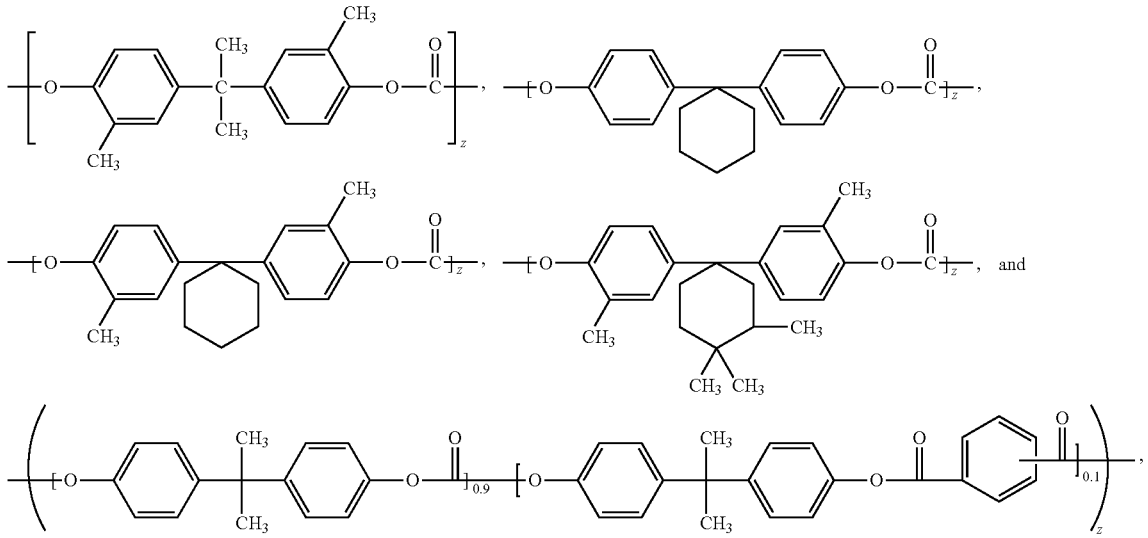

wherein z is 50 to 400.

In further embodiments, there is provided a flexible imaging member comprising: a flexible substrate, a charge generating layer disposed on the substrate, and at least one charge transport layer disposed on the charge generating layer, wherein the charge transport layer comprises a charge transport component molecularly dispersed in a low surface energy polycarbonate binder and at least one plasticizer, the low surface energy polymer binder being an A-B di-block copolymer comprising two segmental blocks, the first segment block (A) being

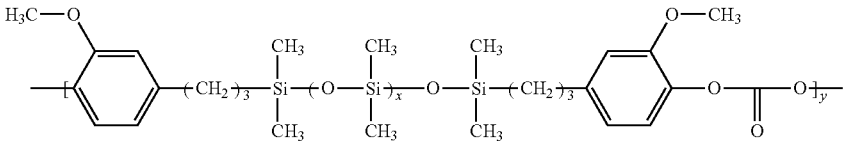

wherein x is 10 to 70, y is 1 to 15, and the second segment block (B) being selected from the group consisting of

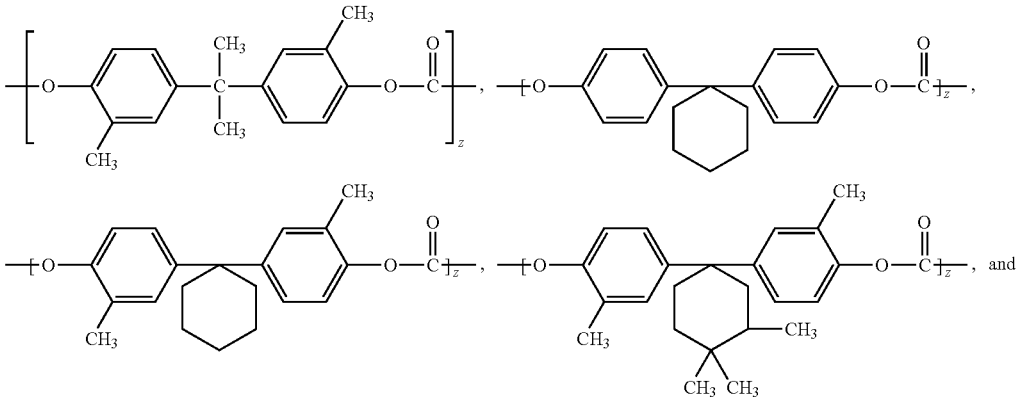

-continued

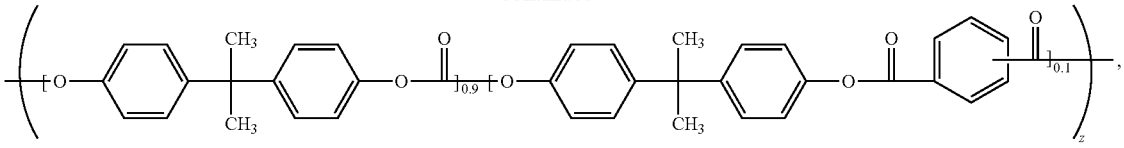

wherein z is 50 to 400, and the plasticizers being selected from the group consisting of liquid phthalates, liquid monomeric bisphenol carbonates, oligomeric polystyrenes and fluoroketones.

In yet further embodiments, there is provided an image forming apparatus for forming images on a recording medium comprising: a) a flexible imaging member having a charge retentive-surface for receiving an electrostatic latent image thereon, wherein the flexible imaging member comprises a flexible substrate, a charge generating layer disposed on the substrate, and at least one charge transport layer disposed on the charge generating layer, wherein the charge transport layer comprises a charge transport component molecularly dispersed in a low surface energy polycarbonate binder and at least one plasticizer, the low surface energy polymer binder being an A-B di-block copolymer comprising two segmental blocks, the first segment block (A) being

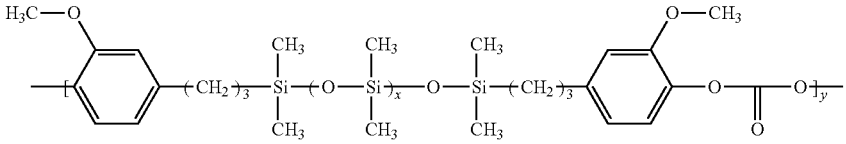

wherein x is 10 to 70, y is 1 to 15, and the second segment block (B) being selected from the group consisting of

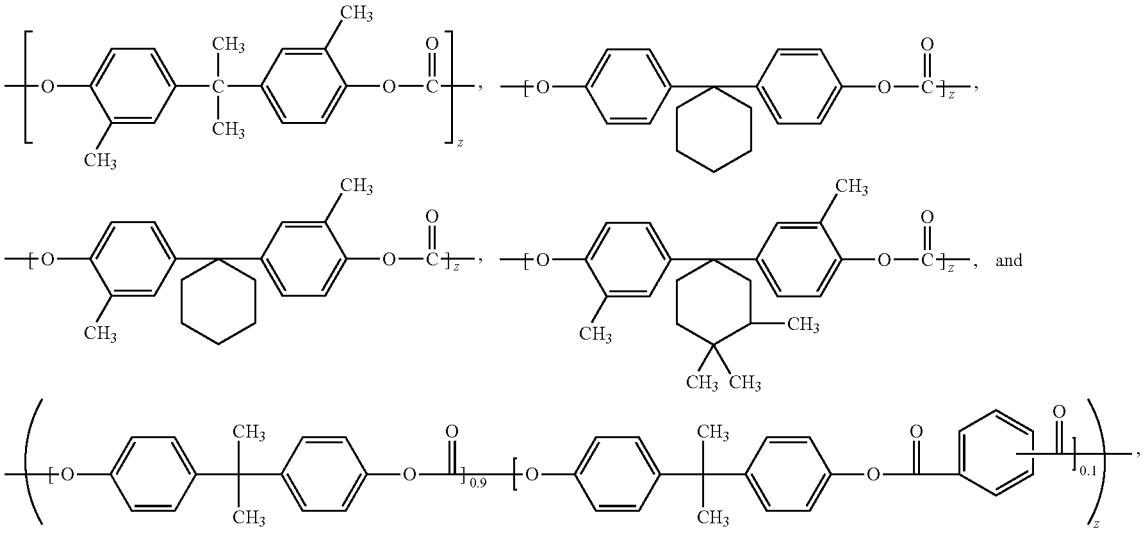

wherein z is 50 to 400, and the plasticizers being selected from the group consisting of liquid phthalates, liquid monomeric bisphenol carbonates, oligomeric polystyrenes and fluoroketones, b) a development component for applying a developer material to the charge-retentive surface to develop the electrostatic latent image to form a developed image on the charge-retentive surface, c) a transfer component for transferring the developed image from the charge-retentive surface to a copy substrate, and d) a fusing component for fusing the developed image to the copy substrate.

BRIEF DESCRIPTION OF THE DRAWINGS

For a better understanding of the present disclosure, reference may be had to the accompanying figures.

DETAILED DESCRIPTION

Figure 1:
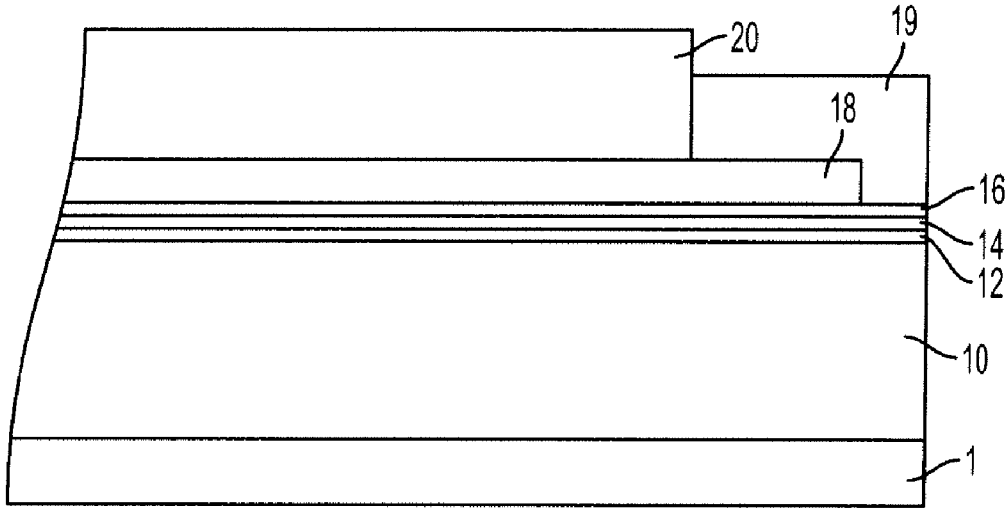
FIG. 1 is a cross-sectional view of a flexible multilayered electrophotographic imaging member having the configuration and structural design according to the conventional description.

In the following description of curl-free and slippery surface imaging members preparation method, reference is made to the accompanying drawings, which form a part hereof and which illustrate several embodiments. It is understood that other embodiments may be utilized and structural and operational changes may be made without departure from the scope of the present embodiments.

According to aspects illustrated herein, there is provided an imaging member comprising a substrate, a CGL disposed on the substrate, and at least one CTL disposed on the charge generating layer, wherein the CTL comprises a low surface energy polycarbonate binder, a charge transport compound of N,N'-diphenyl-N,N'-bis(3-methylphenyl)-1,1-biphenyl-4,4'-diamine, and a plasticizing liquid compound having a high boiling point, and further wherein the liquid compound is miscible with both the polycarbonate and N,N'-diphenyl-N,N'-bis(3-methylphenyl)-1,1-biphenyl-4,4'-diamine. In a modified embodiment, there is provided an imaging member comprising a substrate, a CGL disposed on the substrate, and at least one CTL disposed on the CGL, wherein the CTL comprises a polymer blended binder consisting of the low surface energy polycarbonate and a film forming polycarbonate, a charge transport compound of N,N'-diphenyl-N,N'-bis(3-methylphenyl)-1,1-biphenyl-4,4'-diamine, and a plasticizing liquid compound having a high boiling point, and further wherein the liquid compound is miscible with both the polycarbonate and N,N'-diphenyl-N,N'-bis(3-methylphenyl)-1,1-biphenyl-4,4'-diamine.

First, to render CTL surface slipperiness, it is required that the CTL is prepared to comprise a charge transport component molecularly dispersed in a low surface energy polycarbonate binder, the polymer binder being an A-B di-block copolymer comprising two segmental blocks, having a polydimethyl siloxane (PDMS) containing a first segmental block (A) of

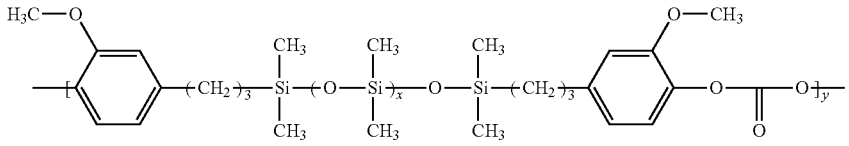

wherein x is 10 to 40, y is 1 to 15, and the second segmental block (B) being selected from the group consisting of

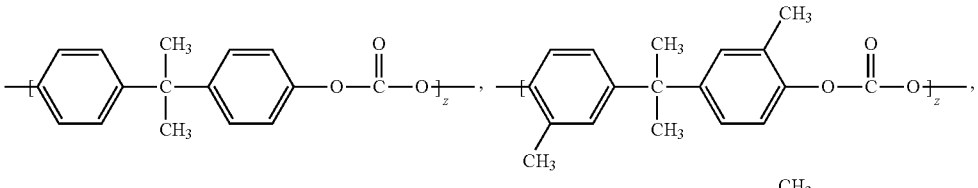

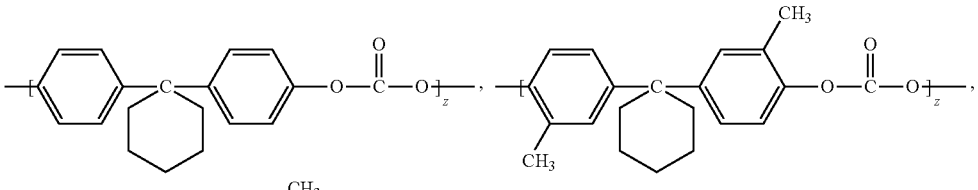

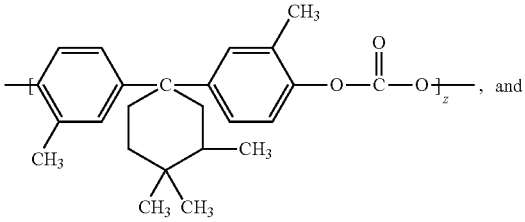

, and

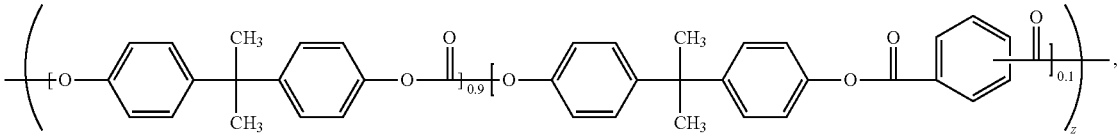

wherein z is 50 to 400.

Surface slipperiness can be defined as the surface of the top outer exposed coating layer in the imaging member that has low surface contact friction to allow machine contacting subsystems such cleaning blade, cleaning brush, tab blade, and the like to easily slide over it without causing notable surface abrasion and wear during electrophotographic imaging and cleaning processes. The example of one specific slippery CTL is formulated to comprise a charge transport component molecularly dispersed in a low surface energy polycarbonate binder, the polymer binder being created from modifying the Bisphenol A polycarbonate poly(4,4'-isopropylidene diphenyl carbonate) to include of from about 2 percent to about 10 percent by weight of polydimethyl siloxane (PDMS) containing segments present in the low surface energy polycarbonate back bone and give the following molecular formula:

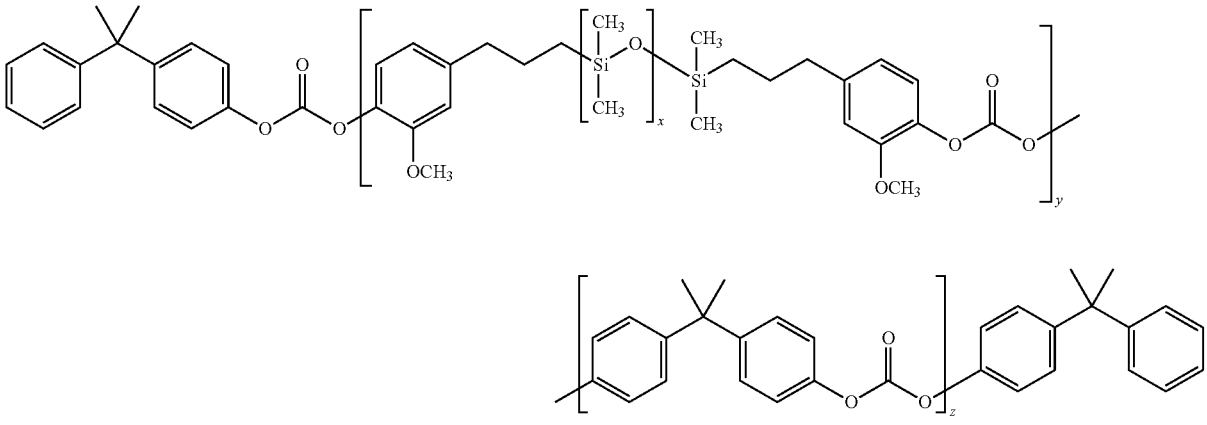

wherein x is 10 to 70, y is 1 to 15, and z is 50 to 400.

Second, to impart the CTL with internal stress/strain relief to eliminate and/or control the curling effect as well as surface slipperiness for contact friction reduction, the CTL is reformulated to comprise a charge transport component molecularly dispersed in a low surface energy polycarbonate binder and plus the incorporation of a compatible liquid plasticizer. The plasticizer imparts curl control by relieving internal stress/strain. Plasticizers chosen to satisfy the present disclosure CTL internal stress/strain reduction need are divided into two categories. Namely (a) organic liquid plasticizers including phthalates, bisphenol liquids, and oligomeric styrenes and (b) fluoro-containing organic liquids which are capable of maximizing the CTL surface energy reduction effect.

Organic Liquid Plasticizers

The liquid phthalates are represented by the following:

Formula (I)

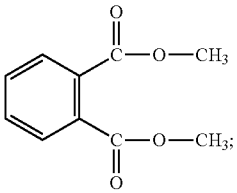

-continued

Formula (IA)

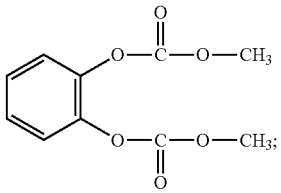

-continued

Formula (II)

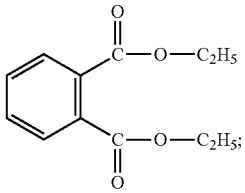

Formula (IIA)

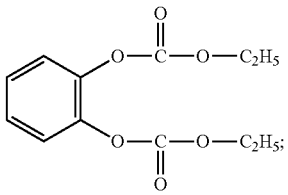

Formula (III)

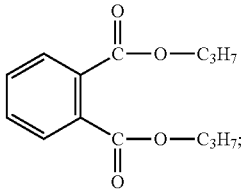

-continued

Formula (IV)

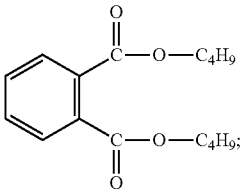

Formula (V)

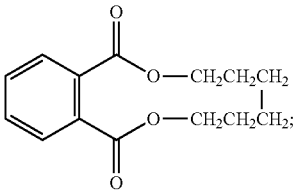

Formula (VI)

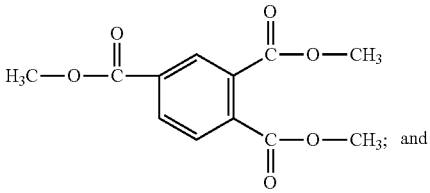

Formula (VII)

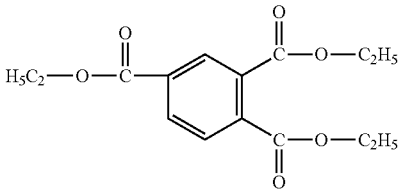

The monomeric liquid bisphenol carbonates as represented by the following:

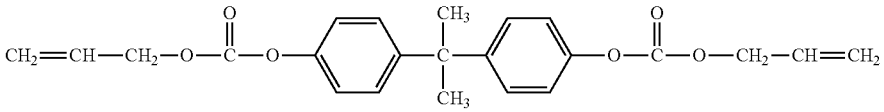

Formula (1)

For present disclosure extension, alternate plasticizing carbonate liquids that are also viable for incorporation into the charge transport layer according to the present embodiments may be conveniently derived from Formula (1) to give molecular structures described in the following Formulas (2) to (5):

Formula (2)

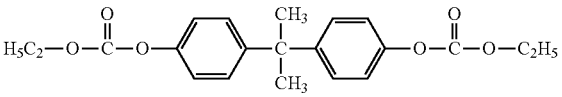

Formula (3)

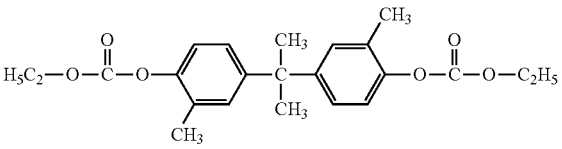

-continued

Formula (4)

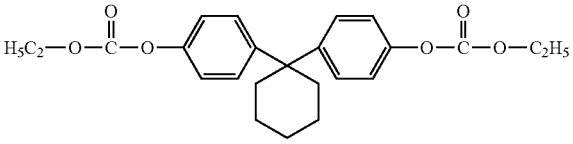

Formula (5)

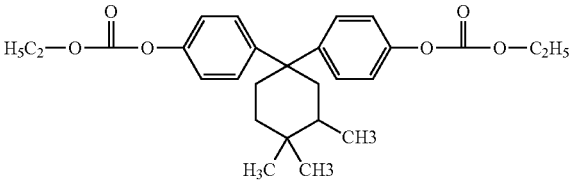

The oligomeric polystyrenes represented by the following:

Formula (A)

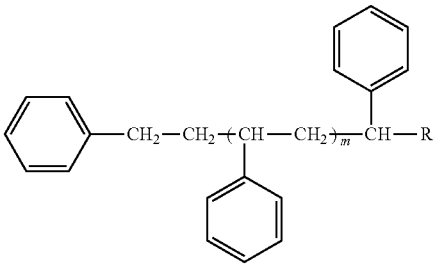

wherein R is selected from the group consisting of H, $CH_3$, $CH_2CH_3$, and $CH{=}CH_2$, and where m is between 0 and 3; and Formula (B)

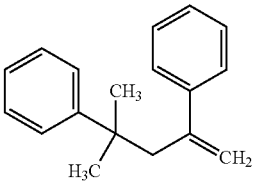

Fluoro-Containing Organic Liquids

The fluoro-containing organic liquids are to be used not only to render plasticizing effect for eliminating the CTL internal stress/strain build-up for curl control, it does also provide a supplementary surface energy reduction effect synergistically with the low surface energy polymer binder for maximizing the surface slipperiness enhancement in the resulting CTL. Therefore, the fluoro-organic liquids selected for CTL plasticizing application are primarily of fluoroketones. These compounds are namely, 3-(trifluoromethyl)phenylacetone, 2'-(trifluoromethyl)propiophenone, 2,2,2-trifluoro-2',4'-dimethoxyacetophenone, 3',5'-bis(trifluoromethyl)acetophenone, 3'-(trifluoromethyl)

propiophenone, 4'-(trifluoromethyl)propiophenone, 4,4,4-trifluoro-1-phenyl-1,3-butanedione, 4,4-difluoro-1-phenyl-1,3-butanedione, having the molecular structures shown below:

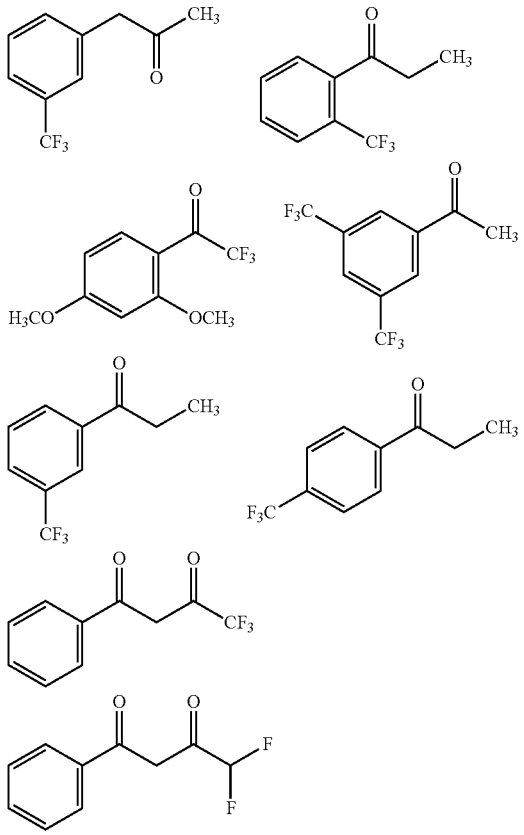

In one embodiment, there is provided an imaging member comprising a substrate, a CGL disposed on the substrate, and at least two CTLs having the bottom layer disposed onto the CGL, wherein all the CTLs comprise a film forming polycarbonate binder, a charge transport compound of N,N'-diphenyl-N,N'-bis(3-methylphenyl)-1,1'-biphenyl-4,4'-diamine, and a plasticizing liquid compound having a high boiling point, and further wherein the liquid compound is miscible with both the polycarbonate binder and N,N'-diphenyl-N,N'-bis(3-methylphenyl)-1,1'-biphenyl-4,4'-diamine charge transport compound, and further wherein the film forming polycarbonate binder in the bottom charge transport layer is bisphenol A polycarbonate and the film forming polycarbonate in the top outermost exposed layer is a low surface energy polycarbonate.

In a further embodiment, there is provided an imaging member comprising a substrate and a single imaging layer disposed on the substrate, wherein the single imaging layer disposed on the substrate has both charge generating and charge transporting capability and further wherein the single imaging layer comprises a polymer blended binder consisting of a low surface energy polycarbonate and a film forming polycarbonate, N,N'-diphenyl-N,N'-bis(3-methylphenyl)-1,1'-biphenyl-4,4'-diamine charge transport compound, a charge generating pigment, and a plasticizing liquid compound having a high boiling point and being miscible with both the polymer blended binder and N,N'-diphenyl-N,N'-bis(3-methylphenyl)-1,1'-biphenyl-4,4'-diamine charge transport compound.

In summary, there is provided a slippery surface and curl-free flexible imaging member comprising a flexible substrate, a conductive ground plane, a hole blocking layer, a CGL, and a slippery CTL without the application of an ACBC disposed onto the substrate on the side opposite of the CTL; wherein, the CTL, being a solid solution consisting of a film forming polymer binder (of a low surface energy polycarbonate or a polymer blended binder consisting of a low surface energy polycarbonate and a film forming polycarbonate) and a charge transporting compound, is formulated to have little or nil internal build-in stress/strain through the incorporation of a suitable plasticizer. For multiple CTLs, the film forming polymer binder in the top outer exposed layer is a low surface energy polycarbonate.

An exemplary embodiment of a conventional negatively charged flexible electrophotographic imaging member is illustrated in FIG. 1. The flexible substrate 10 has an optional conductive layer 12. An optional hole blocking layer 14 disposed onto the conductive layer 12 is coated over with an optional adhesive layer 16. The CGL 18 is located between the adhesive layer 16 and the CTL 20. An optional ground strip layer 19 operatively connects the CGL 18 and the CTL 20 to the conductive ground plane 12. An ACBC 1 is applied to the side of the substrate 10 opposite from the electrically active layers to render imaging member flatness.

The layers of the imaging member include, for example, an optional ground strip layer 19 that is applied to one edge of the imaging member to promote electrical continuity with the conductive ground plane 12 through the hole blocking layer 14. The conductive ground plane 12, which is typically a thin metallic layer, for example a 10 nanometer thick titanium coating, may be deposited over the substrate 10 by vacuum deposition or sputtering process. The other layers 14, 16, 18, 20 and 43 are to be separately and sequentially deposited, onto to the surface of conductive ground plane 12 of substrate 10 respectively, as wet coating layer of solutions comprising a solvent, with each layer being dried before deposition of the next subsequent one. An ACBC 1 may then be formed on the backside of the support substrate 1. The ACBC 1 is also solution coated, but is applied to the back side (the side opposite to all the other layers) of substrate 1, to render imaging member flatness.

The Flexible Substrate

The imaging member support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The support substrate 10 can also be formulated entirely of an electrically conductive material, or it can be an insulating material including inorganic or organic polymeric materials, such as, MYLAR, a commercially available biaxially oriented polyethylene terephthalate from DuPont, or polyethylene naphthalate (PEN) available as KALEDEX 2000, with a ground plane layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations. The substrate may have a number of many different configurations, such as, for example, a plate, a drum, a scroll, an endless flexible belt, and the like. In one embodiment, the substrate is in the form of a seamed flexible belt.

The thickness of the support substrate 10 depends on numerous factors, including flexibility, mechanical performance, and economic considerations. The thickness of the support substrate may range from about 50 micrometers to about 3,000 micrometers. In embodiments of flexible imaging member belt preparation, the thickness of substrate used is from about 50 micrometers to about 200 micrometers for achieving optimum flexibility and to effect tolerable induced imaging member belt surface bending stress/strain when a belt is cycled around small diameter rollers in a machine belt support module, for example, the 19 millimeter diameter rollers.

An exemplary functioning support substrate 10 is not soluble in any of the solvents used in each coating layer solution, has good optical transparency, and is thermally stable up to a high temperature of at least 150° C. A typical support substrate 10 used for imaging member fabrication has a thermal contraction coefficient ranging from about $1\times10^{-5}$/° C. to about $3\times10^{-5}$/° C. and also with a Young's Modulus of between about $5\times10^{5}$ psi ($3.5\times10^{4}$ Kg/cm2) and about $7\times10^{5}$ psi ($4.9\times10^{4}$ Kg/cm2).

The Conductive Ground Plane

The conductive ground plane layer 12 may vary in thickness depending on the optical transparency and flexibility desired for the electrophotographic imaging member. For a typical flexible imaging member belt, it is desired that the thickness of the conductive ground plane 12 on the support substrate 10, for example, a titanium and/or zirconium conductive layer produced by a sputtered deposition process, is in the range of from about 2 nanometers to about 75 nanometers to effect adequate light transmission through for proper back erase. In particular embodiments, the range is from about 10 nanometers to about 20 nanometers to provide optimum combination of electrical conductivity, flexibility, and light transmission. For electrophotographic imaging process employing back exposure erase approach, a conductive ground plane light transparency of at least about 15 percent is generally desirable. The conductive ground plane need is not limited to metals. Nonetheless, the conductive ground plane 12 has usually been an electrically conductive metal layer which may be formed, for example, on the substrate by any suitable coating technique, such as a vacuum depositing or sputtering technique. Typical metals suitable for use as conductive ground plane include aluminum, zirconium, niobium, tantalum, vanadium, hafnium, titanium, nickel, stainless steel, chromium, tungsten, molybdenum, combinations thereof, and the like. Other examples of conductive ground plane 12 may be combinations of materials such as conductive indium tin oxide as a transparent layer for light having a wavelength between about 4000 Angstroms and about 9000 Angstroms or a conductive carbon black dispersed in a plastic binder as an opaque conductive layer. However, in the event where the entire substrate is chosen to be an electrically conductive metal, such as in the case that the electrophotographic imaging process designed to use front exposure erase, the outer surface thereof can perform the function of an electrically conductive ground plane so that a separate electrical conductive layer 12 may be omitted.

For the reason of convenience, all the illustrated embodiments herein after will be described in terms of a substrate layer 10 comprising an insulating material including organic polymeric materials, such as, MYLAR or PEN having a conductive ground plane 12 comprising of an electrically conductive material, such as titanium or titanium/zirconium, coating over the support substrate 10.

The Hole Blocking Layer

A hole blocking layer 14 may then be applied to the conductive ground plane 12 of the support substrate 10. Any suitable positive charge (hole) blocking layer capable of forming an effective barrier to the injection of holes from the adjacent conductive layer 12 into the overlaying photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer 14 may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl)methyl diethoxysilane which has the formula [H2N(CH2)-4]CH3Si(OCH3)2, and (gamma-aminopropyl) methyl diethoxysilane, which has the formula [H2N(CH2)3] CH3Si(OCH3)2, and combinations thereof, as disclosed, for example, in U.S. Pat. Nos. 4,338,387; 4,286,033; and 4,291, 110, incorporated herein by reference in their entireties. A specific hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988, 597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. Patents are incorporated herein by reference in their entireties.

The hole blocking layer 14 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 16 may be provided. In the embodiment illustrated in FIG. 1, an interface layer 16 is situated intermediate the blocking layer 14 and the charge generator layer 18. The adhesive interface layer 16 may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-1200, VITEL PE-2200, VITEL PE-2200D, and VITEL PE-2222, all from Bostik, 49,000 polyester from Rohm Hass, polyvinyl butyral, and the like. The adhesive interface layer 16 may be applied directly to the hole blocking layer 14. Thus, the adhesive interface layer 16 in embodiments is in direct contiguous contact with both the underlying hole blocking layer 14 and the overlying charge generator layer 18 to enhance adhesion bonding to provide linkage. However, in some alternative electrophotographic imaging member designs, the adhesive interface layer 16 is entirely omitted.

Any suitable solvent or solvent mixtures may be employed to form a coating solution of the polyester for the adhesive interface layer 36. Typical solvents include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of from about 0.01 micrometers to about 900 micrometers after drying. In embodiments, the dried thickness is from about 0.03 micrometers to about 1 micrometer.

The Charge Generating Layer

The CGL (e.g., charge generating) 18 may thereafter be applied to the adhesive layer 16. Any suitable CGL 18 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the photogenerating layer 18, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder is PCZ-400 (poly(4,4'-dihydroxy-diphenyl-1-1-cyclohexane) which has a MW=40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The photogenerating layer 18 containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Ground Strip Layer

Other layers such as conventional ground strip layer 19 including, for example, conductive particles dispersed in a film forming binder may be applied to one edge of the imaging member to promote electrical continuity with the conductive ground plane 12 through the hole blocking layer 14. Ground strip layer may include any suitable film forming polymer binder and electrically conductive particles. Typical ground strip materials include those enumerated in U.S. Pat. No. 4,664,995, the entire disclosure of which is incorporated by reference herein. The ground strip layer 19 may have a thickness from about 7 micrometers to about 42 micrometers, for example, from about 14 micrometers to about 23 micrometers.

The Charge Transport Layer

The CTL 20 is thereafter applied over the charge generating layer 18 and become, as shown in FIG. 1, the exposed outermost layer of the imaging member. It may include any suitable transparent organic polymer or non-polymeric material capable of supporting the injection of photogenerated holes or electrons from the charge generating layer 18 and capable of allowing the transport of these holes/electrons through the charge transport layer to selectively discharge the surface charge on the imaging member surface. In one embodiment, the charge transport layer 20 not only serves to transport holes, but also protects the charge generating layer 18 from abrasion or chemical attack and may therefore extend the service life of the imaging member. The charge transport layer 20 can be a substantially non-photoconductive material, but one which supports the injection of photogenerated holes from the charge generation layer 18. The CTL 20 is normally transparent in a wavelength region in which the electrophotographic imaging member is to be used when exposure is effected therethrough to ensure that most of the incident radiation is utilized by the underlying CGL 18. The CTL should exhibit excellent optical transparency with negligible light absorption and neither charge generation nor discharge if any, when exposed to a wavelength of light useful in xerography, e.g., 400 to 900 nanometers. In the case when the imaging member is prepared with the use of a transparent support substrate 10 and also a transparent conductive ground plane 12, image wise exposure or erase may be accomplished through the substrate 10 with all light passing through the back side of the support substrate 10. In this particular case, the materials of the CTL 20 need not have to be able to transmit light in the wavelength region of use for electrophotographic imaging processes if the charge CGL 18 is sandwiched between the support substrate 10 and the CTL 20. In all events, the top outermost exposed CTL 20 in conjunction with the CGL 18 is an insulator to the extent that an electrostatic charge deposited/placed over the charge transport layer is not conducted in the absence of radiant illumination. Importantly, the CTL 20 should trap minimal or no charges as the charge pass through it during the image copying/printing process.

The CTL 20 is a two components solid solution which may include any suitable charge transport component or charge activating compound useful as an additive molecularly dispersed in an electrically inactive polymeric material to form a solid solution and thereby making this material electrically active. The charge transport compound may be added to a film forming binder of polymeric material which is otherwise incapable of supporting the injection of photo generated holes from the generation material and incapable of allowing the transport of these holes there through. This converts the electrically inactive polymeric material to a material capable of supporting the injection of photogenerated holes from the CGL 18 and capable of allowing the transport of these holes through the CTL 20 in order to discharge the surface charge on the charge transport layer. The charge transport component typically comprises small molecules of an organic compound which cooperate to transport charge between molecules and ultimately to the surface of the CTL.

Any suitable inactive resin binder soluble in methylene chloride, chlorobenzene, or other suitable solvent may be employed in the charge transport layer. Exemplary binders include polyesters, polyvinyl butyrals, polycarbonates, polystyrene, polyvinyl formals, and combinations thereof. The polymer binder used for the charge transport layers may be, for example, selected from the group consisting of polycarbonates, poly(vinyl carbazole), polystyrene, polyester, polyarylate, polyacrylate, polyether, polysulfone, combinations thereof, and the like. Exemplary polycarbonates include poly (4,4'-isopropylidene diphenyl carbonate), poly(4,4'-diphenyl-1,1'-cyclohexane carbonate), and combinations thereof. The molecular weight of the polymer binder used in the CTL can be, for example, from about 20,000 to about 1,500,000.

Exemplary charge transport components include aromatic polyamines, such as aryl diamines and aryl triamines. Exemplary aromatic diamines include N,N'-diphenyl-N,N'-bis (alkylphenyl)-1,1'-biphenyl-4,4-diamines, such as mTBD, which has the formula (N,N'-diphenyl-N,N'-bis[3-methylphenyl]-[1,1'-biphenyl]-4,4'-diamine); N,N'-diphenyl-N,N'-bis(chlorophenyl)-1,1'-biphenyl-4,4'-diamine; and N,N'-bis-(4-methylphenyl)-N,N'-bis(4-ethylphenyl)-1,1'-3,3'-dimethylbiphenyl)-4,4'-diamine (Ae-16), N,N'-bis-(3,4-dimethylphenyl)-4,4'-biphenyl amine (Ae-18), and combinations thereof.

Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987, 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl)methanes, as described, for example, in U.S. Pat. No. 3,820,989. The disclosures of all of these patents are incorporated herein be reference in their entireties.

The concentration of the charge transport component in CTL 20 may be, for example, at least about 5 weight % and may comprise up to about 60 weight %. The concentration or composition of the charge transport component may vary through layer 20, as disclosed, for example, in U.S. Pat. No. 7,033,714; U.S. Pat. No. 6,933,089; and U.S. Pat. No. 7,018,756, the disclosures of which are incorporated herein by reference in their entireties.

In one exemplary embodiment, CTL 20 comprises an average of about 10 to about 60 weight percent N,N'-diphenyl-N,N'-bis(3-methylphenyl)-1,1'-biphenyl-4,4'-diamine, or from about 30 to about 50 weight percent N,N'-diphenyl-N,N'-bis (3-methylphenyl)-1,1'-biphenyl-4,4'-diamine.

The CTL 20 is an insulator to the extent that the electrostatic charge placed on the charge transport layer is not conductive in the absence of illumination at a rate sufficient to prevent formation and retention of an electrostatic latent image thereon. In general, the ratio of the thickness of the CTL 20 to the charge generator layer 18 is maintained from about 2:1 to about 200:1 and in some instances as great as about 400:1.

Additional aspects relate to the inclusion in the charge transport layer 20 of variable amounts of an antioxidant, such as a hindered phenol. Exemplary hindered phenols include octadecyl-3,5-di-tert-butyl-4-hydroxyhydrociannamate, available as IRGANOX I-1010 from Ciba Specialty Chemicals. The hindered phenol may be present at about 10 weight percent based on the concentration of the charge transport component. Other suitable antioxidants are described, for example, in above-mentioned U.S. application Ser. No. 10/655,882 incorporated by reference.

In one specific embodiment, the CTL 20 is a solid solution including a charge transport compound, such as N,N'-diphenyl-N,N'-bis(3-methylphenyl)-1,1'-biphenyl-4,4'-diamine, molecularly dissolved in a film forming polycarbonate binder, the film forming binder being either a bisphenol A polycarbonate of poly(4,4'-isopropylidene diphenyl carbonate) or a poly(4,4'-diphenyl-1,1'-cyclohexane carbonate). The Bisphenol A polycarbonate used for typical charge transport layer formulation is MAKROLON which is commercially available from Farbensabricken Bayer A.G or is the FPC 0170 available from Mitsubishi Chemicals. This commercial bisphenol A polycarbonate, poly(4,4'-isopropylidene diphenyl carbonate), has a molecular weight of about 120,000 to 150,000 and a molecular structure of given in Formula (A) below:

Formula (A)

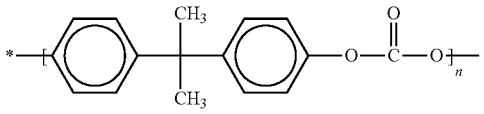

wherein n indicates the degree of polymerization. In the alternative, poly(4,4'-diphenyl-1,1'-cyclohexane carbonate) may also be used to ACBC use in place of MAKROLON or FPC 0170. The molecular structure of poly(4,4'-diphenyl-1,1'-cyclohexane carbonate), having a weight average molecular weight of about between about 20,000 and about 200,000, is given in Formula (B) below:

Formula (B)

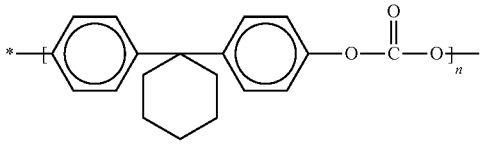

wherein n indicates the degree of polymerization.

Examples of charge transport compounds used in the CTL include, but are not limited to, triphenylmethane; bis(4-diethylamine-2-methylphenyl)phenylmethane; stilbene; hydrazone; an aromatic amine comprising tritolylamine; arylamine; enamine phenanthrene diamine; N,N'-bis(4-methylphenyl)-N,N'-bis[4-(1-butyl)-phenyl]-[p-terphenyl]-4,4'-diamine; N,N'-bis(3-methylphenyl)-N,N'-bis[4-(1-butyl)-phenyl]-[p-terphenyl]-4,4'-diamine; N,N'-bis(4-t-butylphenyl)-N,N'-bis[4-(1-butyl)-phenyl]-[p-terphenyl]-4,4'-diamine; N,N,N',N'-tetra[4-(1-butyl)-phenyl]-[p-terphenyl]-4,4'-diamine; N,N,N',N'-tetra[4-t-butyl-phenyl]-[p-terphenyl]-4,4'-diamine; N,N'-diphenyl-N,N'-bis(4-methylphenyl)-1,1'-biphenyl-4,4'-diamine; N,N'-bis(4-methylphenyl)-N,N'-bis(4-ethylphenyl)-1,1'-(3,3'-dimethylbiphenyl)-4,4'-diamine; 4,4'-bis(diethylamino)-2,2'-dimethyltriphenylmethane; N,N'-diphenyl-N,N'-bis(3-methylphenyl)-[1,1'-biphenyl]-4,4'-diamine; N,N'-diphenyl-N,N'-bis(alkylphenyl)-1,1'-biphenyl-4,4'-diamine; and N,N'-diphenyl-N,N'-bis(chlorophenyl)-1,1'-biphenyl-4,4'-diamine. Combinations of different charge compounds are also contemplated so long as they are present in an effective amount. In further embodiments, the charge transport compound is a diamine represented by the molecular structure below:

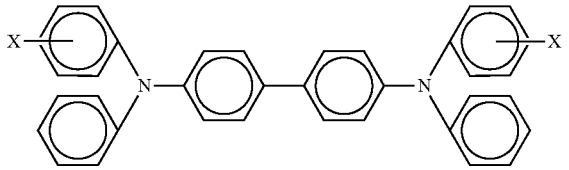

wherein X is selected from the group consisting of alkyl, hydroxy, and halogen. Such diamines are disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507; these disclosures are herein incorporated in their entirety for reference.

The charge transport compound may comprise from about 10 to about 90 weight percent of the CTL, based on the total weight of the CTL. In an exemplary embodiment, the charge transport compound comprises from about 35 to about 75 weight percent or from about 60 to about 70 weight percent of the CTL for optimum function. Typically, the CTL has a thickness of from about 10 to about 40 micrometers. It may also have a Young's Modulus in the range of from about $3.0\times10^5$ psi to about $4.5\times10^5$ psi, a thermal contraction coefficient of from about $6\times10^{-5}$/° C. to about $8\times10^{-5}$/° C.

Since the CTL 20 can have a substantially greater thermal contraction coefficient constant compared to that of the flexible support substrate 10, the prepared flexible electrophotographic imaging member will typically exhibit spontaneous upward curling into a 1½ inch roll if unrestrained, after CTL application and through elevated temperature drying then cooling processes, due to the result of larger dimensional contraction in the CTL 20 than the support substrate 10, as the imaging member cools from the glass transition temperature of the CTL down to room ambient temperature of 25° C. after the heating/drying processes of the applied wet CTL coating. Therefore, a substantial internal tensile pulling strain is build-in in the CTL as it contracts more than that in the substrate after cooling down. The internal strain build-in in the CTL can be expressed in equation (1) below:

$$\in=(\alpha_{CTL}-\alpha_{sub})(Tg_{CTL}-25^\circ\text{ C.}) \quad (1)$$

wherein $\in$ is the internal strain build-in in the CTL, $\alpha_{CTL}$ and $\alpha_{sub}$ are coefficient of thermal contraction of CTL and substrate respectively, and $Tg_{CTL}$ is the glass transition temperature of the CTL. Therefore, equation (1), had indicated that the key to suppress or control the imaging member upward curling is by simply decreasing the $Tg_{CTL}$ of the CTL to minimize the internal stress/strain building up and impact flatness.

However, in this conventional prior art imaging member, an ACBC 1 is required to be applied to the back side of the support substrate 10 (which is the side opposite the side bearing the electrically active coating layers) in order to counteract the curl and render the prepared imaging member with desired flatness.

The Anticurl Back Coating

Since the CTL 20 is applied by solution coating process, the applied wet film is dried at elevated temperature and then subsequently cooled down to room ambient. The resulting imaging member web if, at this point, not restrained, will spontaneously curl upwardly into a 1½ inch tube due to greater dimensional contraction and shrinkage of the CTL than that of the substrate support layer 10. An ACBC 1, as the conventional imaging member shown in FIG. 1, is then applied to the back side of the support substrate 10 (which is the side opposite the side bearing the electrically active coating layers) in order to render the prepared imaging member with desired flatness.

Generally, the ACBC 1 comprises a thermoplastic polymer and an adhesion promoter. The thermoplastic polymer, in some embodiments being the same as the polymer binder used in the CTL, is typically a bisphenol A polycarbonate, which along with the addition of an adhesion promoter of polyester are both dissolved in a solvent to form an ACBC solution. The coated ACBC 1 must adhere well to the support substrate 10 to prevent premature layer delamination during imaging member belt machine function in the field.

In a conventional ACBC, an adhesion promoter of copolyester is included in the bisphenol A polycarbonate poly(4,4'-isopropylidene diphenyl carbonate) material matrix to provide adhesion bonding enhancement to the substrate support. Satisfactory adhesion promoter content is from about 0.2 percent to about 20 percent or from about 2 percent to about 10 percent by weight, based on the total weight of the ACBC. The adhesion promoter may be any known in the art, such as for example, VITEL PE2200 which is available from Bostik, Inc. (Middleton, Mass.). The ACBC has a thickness that is adequate to counteract the imaging member upward curling and provide flatness; so, it is of from about 5 micrometers to about 50 micrometers or between about 10 micrometers and about 20 micrometers. A typical, conventional ACBC formulation of the conventional prior art imaging member of FIG. 1 does therefore have a 92:8 ratio of polycarbonate to adhesive.

Slippery Surface and Curl-Free Imaging Member Disclosure

Figure 2A:
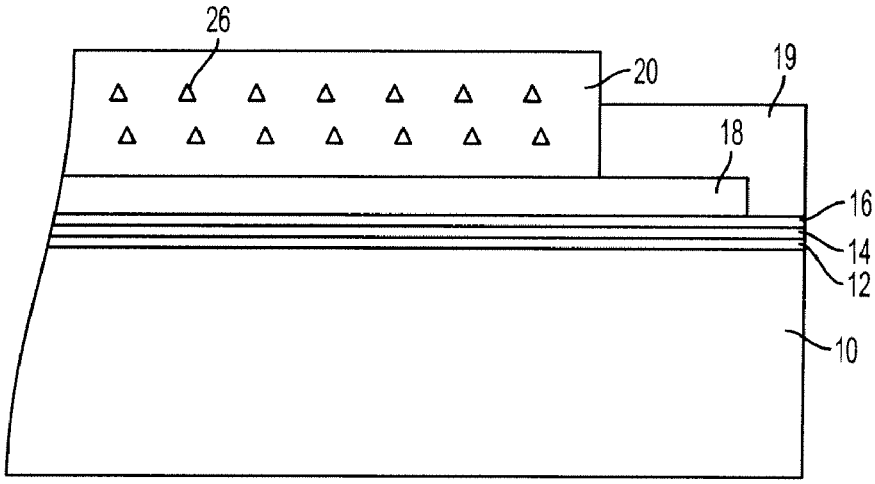
FIG. 2A is a cross-sectional view of a structurally simplified flexible multilayered electrophotographic imaging member having a single charge transport layer according to an embodiment of the present disclosure.

FIG. 2A shows the embodiment of a slippery surface and curl-free flexible imaging member without ACBC prepared according to the material formulation and methodology of the present disclosure. In the embodiments, the substrate 10, conductive ground plane 12, hole blocking layer, 14, adhesive interface layer 16, CGL 18, of the disclosed imaging member are prepared to have very exact same materials, compositions, thicknesses, and follow the identical procedures as those described in the conventional imaging member of FIG. 1, but with the exception that the CTL 20 is re-formulated to include a low surface energy polycarbonate binder to impart surface slipperiness and an organic liquid plasticizer 26 addition to relieve the internal stress/strain build-up for curl control. In further embodiments, the slippery CTL 20 is reformulated to have a polymer blended binder consisting of the low surface energy polycarbonate binder and a film forming bisphenol polycarbonate present in weight ratios of the low surface energy polycarbonate to the bisphenol polycarbonate of between about 10:90 and about 90:10 based on the combined weight of the low surface energy polycarbonate and the film forming bisphenol polycarbonate in the charge transport layer.

The low surface energy polycarbonate selected for the disclosed CTL use is from one of the candidates described in the following paragraphs. They are the low surface energy bisphenol A polycarbonate that is derived/modified from bisphenol A polycarbonate to include PDMS segments in the main polycarbonate chain backbone. It is now a commercially available product as LEXAN EXL1463C and LEXAN EXL 1414T, both available from Sabic Innovative Plastics. As a matter of fact, LEXAN EXL1463C polycarbonate is an improved version of the LEXAN EXL 1414T polycarbonate disclosed in the prior art. Therefore both low surface energy polymers are, by definition, A-B di-block copolymer having same molecular structure which is comprised of two segmental blocks: that is a polydimethyl siloxane (PDMS) containing block (A) and a bisphenol A block (B) polycarbonate backbone shown below:

Block (A)

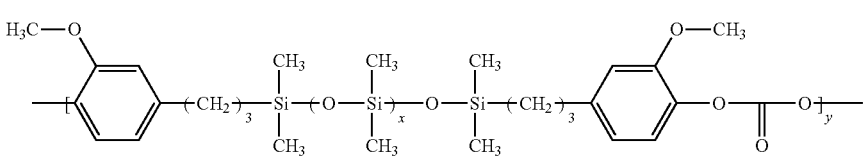

Block (B)

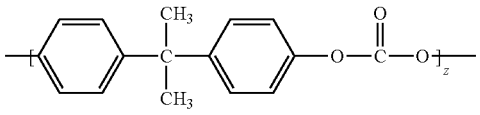

wherein x is the number of PDMS repeat units, ranging from about 10 to about 70; y is number of PDMS containing block (A) segment repeats of between 1 and 15 calculated based on between about 2 and about 10 weight percent of the molecular weight of the low surface energy polycarbonate; and z is the degree of polymerization of the main chain bisphenol A polycarbonate of poly(4,4'-isopropylidene diphenyl carbonate) in Block (B) determined from the molecular weight of this low surface energy polycarbonate, of having from about 15,000 to about 130,000, to give values of 50 to 400. The A-B di-block copolymer is therefore a low surface energy bisphenol A polycarbonate and has a generally molecular structure represented by the formula shown below:

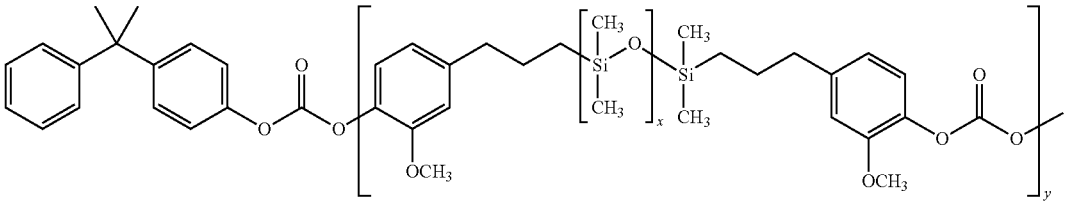

Block (A)

-continued

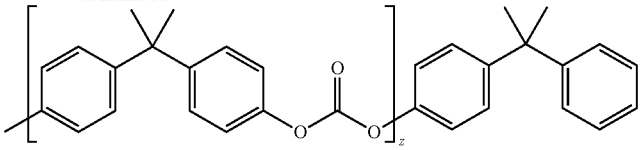

Block (B)

The above low surface energy bisphenol A polycarbonate used for CTL re-formulation has a molecular weight of at least 15,000 but is preferably to be between 20,000 and 130,000 based from solubility, solution viscosity, and coating layer mechanical function considerations. The amount of PDMS containing block (A) segment in the backbone of the bisphenol A polycarbonate main chain block (B) is between about 2 to about 10 weight percent based on the total molecular weight of the low surface energy polycarbonate. Furthermore, the novel low surface energy polycarbonate for use in reformulating the CTL of this disclosure can alternatively be one of the several variances that are conveniently derived/obtained through the modification of block (B) segment of the polycarbonate main chain of the A-B di-block copolymer shown in the above general Formula to give further structures, as shown below.

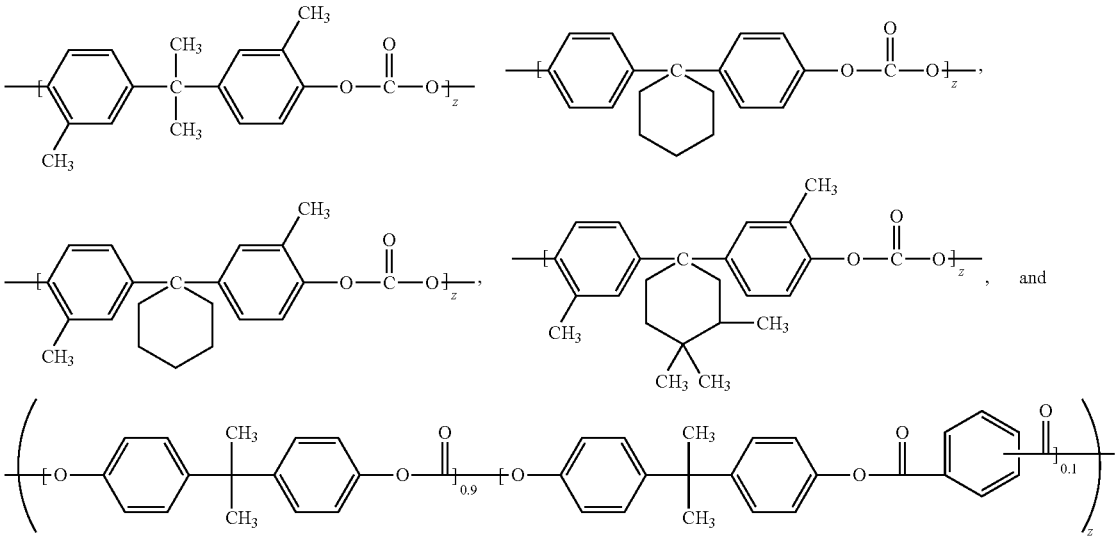

All the low surface energy polycarbonates described in the precedence should contain PDMS, having x repeating units of between about 10 and about 70 to impact acceptable coating layer light transmission. However, it is preferred to be in a range of between about 10 and about 40 to produce satisfactory light transparency; and at specifically about 26, the coating layer has absolute optical clarity. For the amount of PDMS containing block (A) segments present in the main polycarbonate backbone chain of block (B). It is between about 2 and about 10 weight percent based on the total weight of the low surface energy polycarbonate. In specific embodiments, the low surface energy polycarbonate contains from about 4 to about 6 weight percent of PDMS containing block (A) segments. The low surface energy polymer has a molecular weight from about 20,000 to about 200,000. In specific embodiments, it has a molecular weight from about 25,000 to about 130,000 to effect solvent solubility, good coating solution viscosity control, and mechanical property considerations. Since the presence of PDMS containing block (A) in the polycarbonate backbone do reduce the surface energy of the reformulated CTL, it thereby increases the surface lubricity/adhesiveness to impact surface contact friction reduction.

The amount of organic liquid plasticizer 26 incorporated, to impact satisfactory internal stress/strain relief for imaging member curl suppression and control, is from about 3 to about 30 weight percent, based on the total weight of the CTL. But, it is preferred to be between about 5 and about 12 weight percent to impart optimum plasticizing outcome without causing without causing photoelectrical property degradation of the resulting imaging member; that is to substantially depress the Tg of the plasticized CTL, such that the magnitude of (Tg−25° C.) becomes a small value to decrease the CTL internal strain building up, according to equation (1), and provides effective imaging member curling reduction.

The organic liquid plasticizer 26 used is selected from one of the molecular formulas shown below.

Phthalate Plasticizers

A dimethyl phthalate chosen for imaging member CTL plasticizing use is shown in the molecular structure of Formula (1) below:

Formula (I)

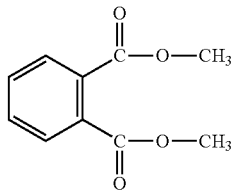

One phthalate candidate derived from Formula (1) capable for plasticizing the charge transport layer and to be included in the present disclosure is shown in the following Formula (IA):

Formula (IA)

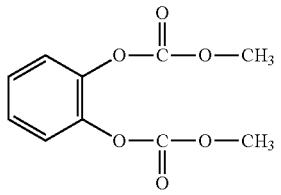

Another phthalate candidate is a diethyl phthalate that has a molecular structure of Formula (II) shown below:

Formula (II)

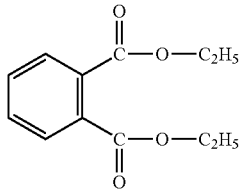

One extended phthalate candidate for the charge transport layer plasticizing derived from Formula (II) and included for present disclosure application is shown in the following Formula (IIA):

Formula (IIA)

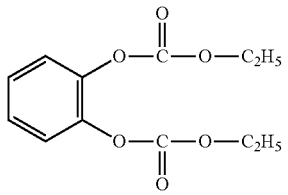

Another phthalate candidate is a dipropyl phthalate which has a molecular structure shown in Formula (III) below:

Formula (III)

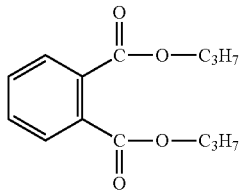

Another phthalate candidate is a dibutyl phthalate having a molecular structure formula given in the following Formula (IV):

Formula (IV)

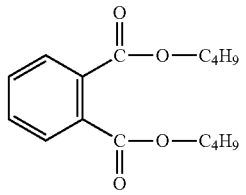

Another phthalate candidate is a hexamethylene phthalate having a particular molecular structure formula shown in Formula (V) below:

Formula (V)

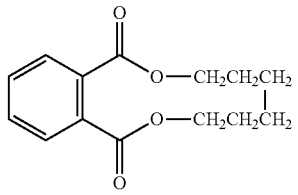

Another phthalate candidate is a trimethyl 1,2,4-benzenetricarboxylate which is described by the following molecular structure formula of Formula (VI):

Formula (VI)

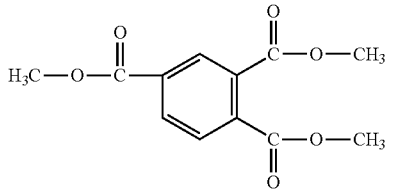

Another phthalate candidate is a triethyl 1,2,4-benzenetricarboxylate which is described according to the molecular structure formula of Formula (VII) below:

Formula (VII)

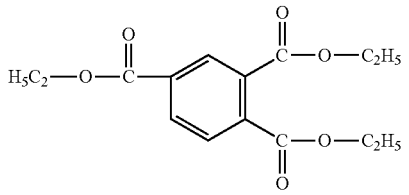

Monomeric Bisphenol Carbonate

Other plasticizing candidates may also be used for incorporation into a charge transport layer. Such candidates include an aromatic monomer of bisphenol A carbonate liquid represented by the molecular structural Formula (1) below:

Formula (1)

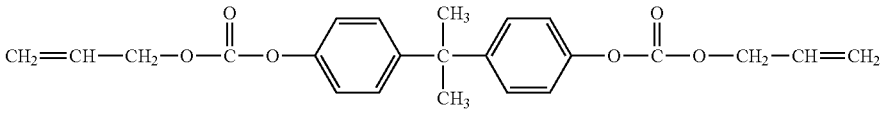

For present disclosure extension, alternate plasticizing carbonate liquids that are also viable for incorporation into the charge transport layer according to the present embodiments may be conveniently derived from Formula (1) to give molecular structures described in the following Formulas (2) to (5):

Formula (2)

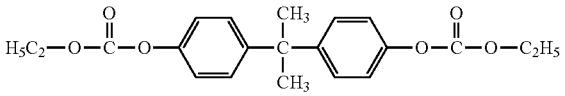

Formula (3)

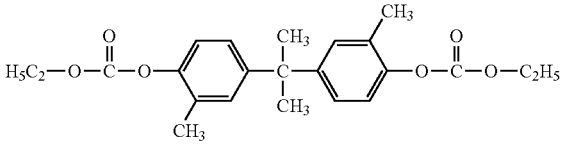

Formula (4)

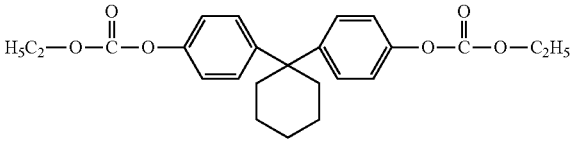

Formula (5)

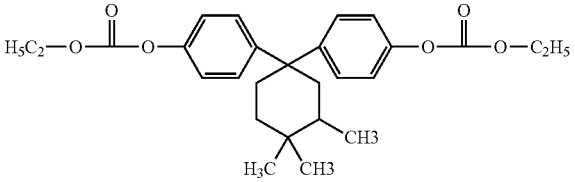

Oligomeric Polystyrenes

To provide the intended charge transport layer plasticizing result for the preparation of an anticurl back coating-free imaging member, two liquid candidates are also included for present disclosure application, which are described below.

An oligomeric polystyrene liquid chosen for charge transport layer plasticizing use has a molecular structure shown in Formula (A) below:

Formula (A)

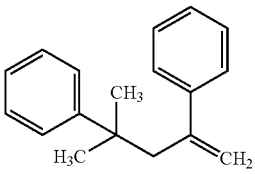

An alternate oligomeric polystyrene is a modified structure derived from Formula (A) to give a methyl styrene dimer liquid of Formula (B) shown below:

Formula (B)

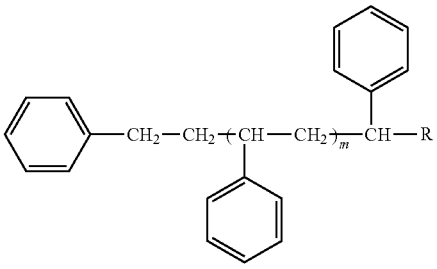

where R is selected from the group consisting of H, $CH_3$, $CH_2CH_3$, and $CH{=}CH_2$, and where m is between 0 and 3.

In modified embodiments, the binder of the plasticized CTL is a polymer blend comprising of the novel film forming low surface energy polycarbonate and a compatible film forming polymer. Typical film forming polymer candidates suitable to blend with the novel low surface energy polycarbonate are polycarbonates having a weight average molecular weight Mw of from about 20,000 to about 250,000 and preferably from about 50,000 to about 120,000 are suitable for forming a coating solution having proper viscosity for easy CTL application. The chosen film forming low surface energy polycarbonate viable for present disclosure application is, again selected from each of the listed A-B di-block copolymers disclosed in the preceding.

Figure 2B:
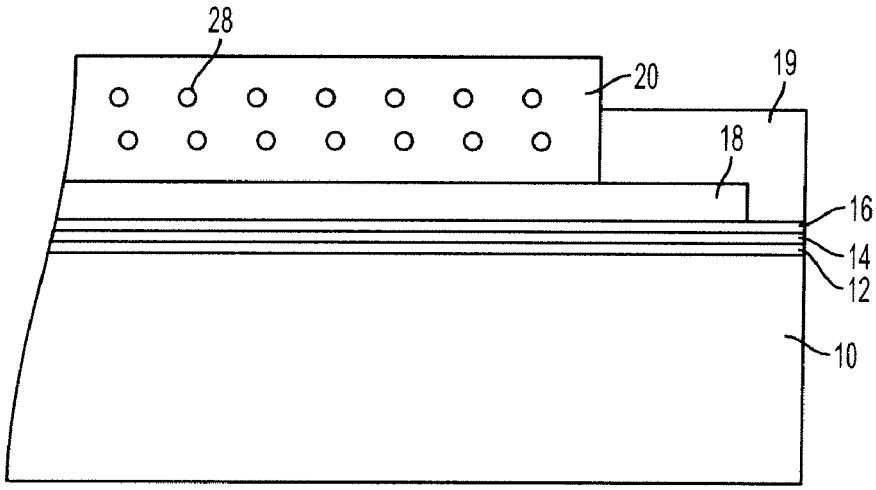
FIG. 2B is a cross-sectional view of another structurally simplified flexible multilayered electrophotographic imaging member having a single charge transport layer according to an embodiment of the present disclosure.

In further embodiments, the preparation of a slippery surface and curl-free flexible imaging member, shown in FIG. 2B, is following the same steps and uses the same material compositions according to those described in above FIG. 2 A, but with the exception that the organic liquid plasticizer 26 used is now replaced with a low surface energy fluoro containing organic liquid 28 incorporating into the CTL. The plasticizing fluoro-containing organic liquids that are suitable for CTL internal stress/strain suppression application as well as capable of maximizing the resulting CTL surface energy reduction effect are liquids of fluoroketone such as 3-(trifluoromethyl)phenylacetone, 2'-(trifluoromethyl)propiophenone; 2,2,2-trifluoro-2',4'-dimethoxyacetophenone; 3',5'-bis(trifluoromethyl)acetophenone; 3'-(trifluoromethyl)propiophenone, 4'-(trifluoromethyl)propiophenone; 4,4,4-trifluoro-1-phenyl-1,3-butanedione; and 4,4-difluoro-1-phenyl-1,3-butanedione, represented by the molecular structures shown below:

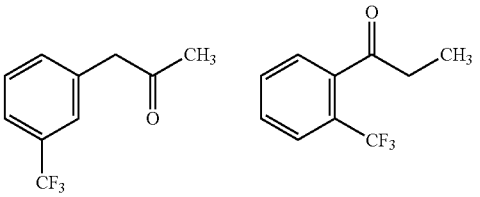

-continued

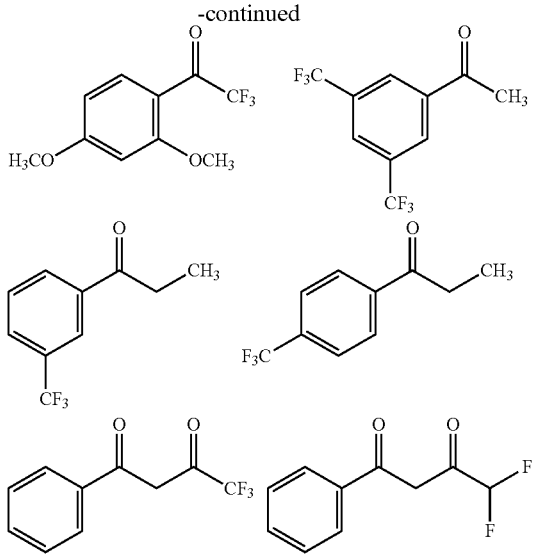

The amount of plasticizing fluoro-containing organic liquid 28 selected from one of the above for incorporation is again from about 3 to about 30 weight percent, based on the total weight of the CTL. Preferably, to be between about 5 and about 12 weight percent to impart optimum plasticizing outcome without causing without causing photoelectrical property degradation of the resulting imaging member. Since fluoro-ketones are by themselves inherently low surface energy liquids, so each incorporation is more than producing the key plasticization impact to minimize the internal stress/strain build-up in CTL for imaging member curl control, it does also provide a supplementary surface energy reduction effect synergistically with the low surface energy polymer binder to maximize the surface slipperiness enhancement in the resulting CTL.

Figure 3:
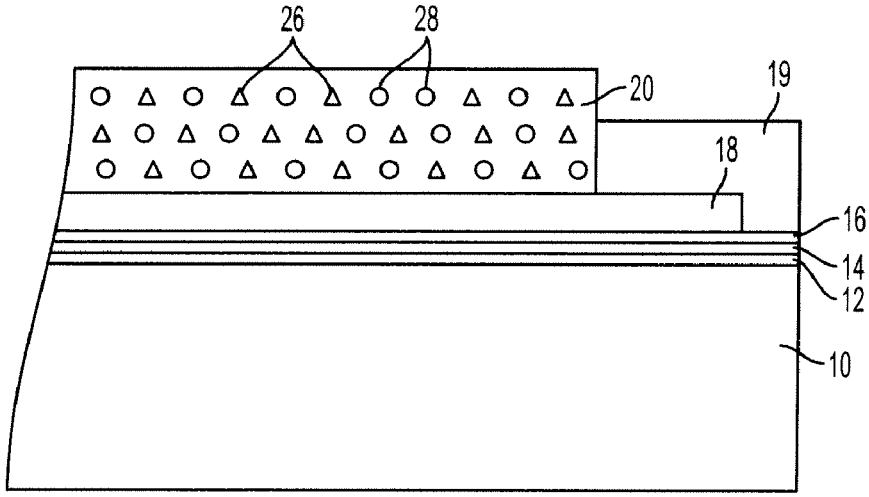
FIG. 3 is a cross-sectional view of yet another structurally simplified flexible multilayered electrophotographic imaging member having a single charge transport layer according to an embodiment of the present disclosure.

Referring to FIG. 3, further extended embodiments of slippery and curl-free imaging members of this disclosure are prepared to have a plasticized CTL 20 which is re-formulated to comprise the same diamine (N,N'-diphenyl-N,N'-bis(3-methylphenyl)-[1,1'-biphenyl]4,4'diamine (m-TBD)) and low surface energy bisphenol A polycarbonate binder composition matrix according to that disclosed in the embodiments of FIGS. 2A and 2B, but with the exception that the single component plasticizer, being of either an organic liquid plasticizer 26 or a fluoro containing ketone 28, present in the CTL 20 has been alternatively replaced with a mixture of equal parts of two plasticizers 26 and 28 in every possible mixing combination. That means the binary plasticizer mixture is formed by mixing each liquid 26 of Formulas (IA), (IIA), (III), (IV), (V), (VI), (VII), (1), (2), (3), (4), (5), (A), and (B) with a liquid 28 selected from each of the eight fluoroketones. The total amount of the two plasticizer mixture present in the CTL of the slippery curl-free imaging member, shown in FIG. 3, is in a range of from about 3 to about 30 weight percent or between about 5 and about 12 weight percent with respect to the total weight the resulting CTL. However, the binary mixture of the two types of plasticizers can be formed of different ratios to achieve a specific disclosure purpose, for example, the weight ratios of organic liquid 26 to fluoroketone 28 in the plasticizer mixture may be prepared to have between about 10:90 and about 90:10. Therefore, the use of these plasticizer mixture ratios in the CTL should provide the option of being able to adjust or tune the slipperiness of the CTL surface at will to meet any specific xerographic machine's need.

Figure 4:
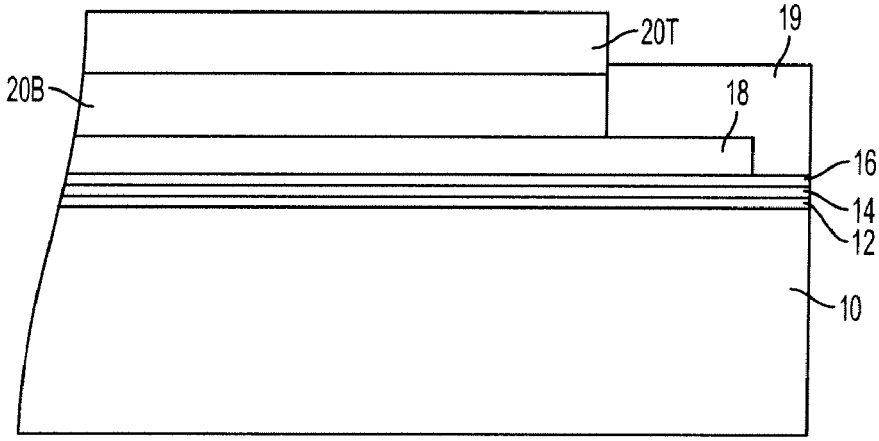
FIG. 4 is a cross-sectional view of a structurally simplified flexible multilayered electrophotographic imaging member having dual charge transport layers according to an embodiment of the present disclosure.

In yet further extension of slippery surface and curl-free imaging member embodiments, shown in FIG. 4, the low surface energy polycarbonate containing slippery CTL 20 is then re-designed to give plasticized dual layers consisting of a bottom layer 20B and a top exposed layer 20T and incorporated into these layers with an organic plasticizing liquid 26. Both plasticized layers are about the same thickness, comprise the same composition of diamine m-TBD and polycarbonate binder, but with the exception that the top exposed layer 20T has a low surface energy polycarbonate binder or a blended binder consisting of a low surface energy polycarbonate and a film forming polycarbonate in any predetermined ratio that gives desirable degree of surface slipperiness to meet each xerographic machine need. That means both layers are comprised of about 30 to about 70 weight percent of N,N'-diphenyl-N,N'-bis(3-methylphenyl)-1,1'-biphenyl-4,4'-diamine (m-TBD) charge transporting compound, about 70 to about 30 weight percent of polymer binder, and the plasticizer incorporated into each of the dual layers is from about 3 to about 30 weight percent or between about 5 and about 12 weight percent with respect to the total weight of each respective layer. In the modification of these very embodiments, the plasticized dual layers are re-formulated again such that the bottom layer 20B contains greater amount of diamine m-TBD than that in the slippery top exposed layer 20T for preserving the photoelectrical integrity and impact best mechanical function of the imaging member; that is the bottom layer 20B is comprised of about 40 to about 70 weight percent diamine m-TBD while the top layer 20T comprises about 20 to about 60 weight percent diamine m-TBD based on the combined weight of diamine m-TBD and polycarbonate binder of the respective layer. In still further extension of all these very same embodiments of FIG. 4, the plasticizing liquid for incorporation into both dual CTLs of the slippery surface and curl-free imaging member is selected from a fluoro-containing organic liquid 28.

In variance embodiments of slippery surface and curl-free imaging member of FIG. 4, both these dual CTLs are plasticized by using the two different categories of plasticizer liquids 26 and 28. Although both of these layers (with the top exposed layer 20T comprising a low surface energy polycarbonate binder or a blended binder consisting of a low surface energy polycarbonate and a film forming polycarbonate in any predetermined ratio to give intended degree of surface slipperiness) are designed to comprise about the same thickness, the same diamine m-TBD and polymer binder composition matrix (that is between about 30 and about 70 weight percent of (m-TBD) to between about 70 and about 30 weight percent of polymer binder), and the same amount of plasticizer liquid incorporation of from about 3 to about 30 weight percent or between about 5 and about 12 weight percent with respect to the total weight of each respective layer; however, the plasticizer included in the bottom layer 20B is liquid 26 while that used in the slippery top outermost layer 20T is a fluoroketone 28 to maximize the surface slipperiness enhancement. In the alternative variance of these very exact same embodiments, these plasticized dual layers are then re-formulated such that the bottom layer 20B contains larger amount of diamine m-TBD than that in the top layer 20T; that is the bottom layer is comprised of about 40 to about 70 weight percent diamine m-TBD while the slippery top outermost layer comprises about 20 to about 60 weight percent diamine m-TBD to improve mechanical function.

In summary, both the plasticized dual CTLs of the slippery surface and curl-free imaging member shown in FIG. 4 are designed to comprise of about same thickness, same diamine m-TBD and polymer binder composition matrix, and same amount of plasticizer liquid (being a single plasticizer or mixture) incorporation of from about 3 to about 30 weight percent or between about 5 and about 12 weight percent with respect to the total weight of each respective layer, but with the exception that the top layer 20T contains a low surface energy polycarbonate to render slipperiness. To maximize the surface slipperiness, the plasticizer incorporated into the top layer is a fluoroketone 28 and that for bottom layer is liquid 26. In the variance and modification of these very same embodiments of FIG. 4, the plasticized dual layers are further re-formulated such that the bottom layer contains larger amount of diamine m-TBD than that in the top layer; that is the bottom layer is comprised of about 40 to about 70 weight percent diamine m-TBD while the top layer comprises about 20 to about 60 weight percent diamine m-TBD for improving mechanical function.

Figure 5:
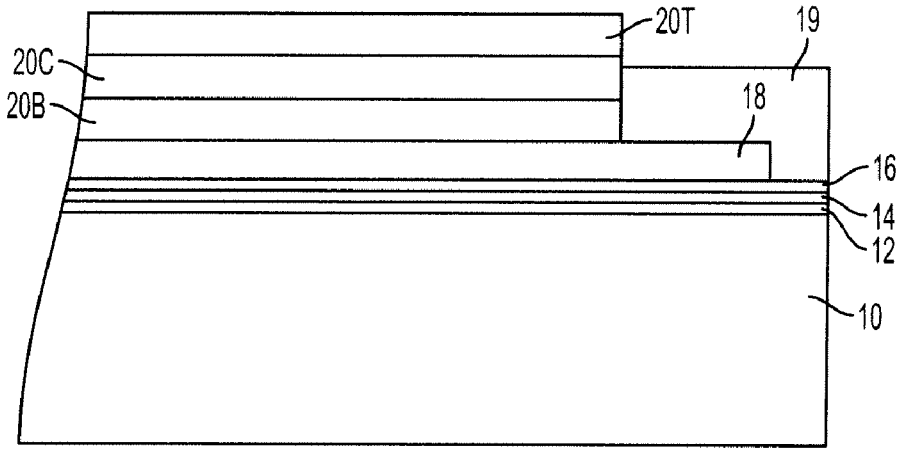
FIG. 5 is a cross-sectional view of a structurally simplified flexible multilayered electrophotographic imaging member having triple charge transport layers according to an embodiment of the present disclosure.

The plasticized CTL in the slippery surface and curl-free imaging members of additional embodiments, shown in FIG. 5, is a re-designed to give triple layers: a bottom layer 206, a center layer 20C, and a slippery top outermost exposed layer 20T containing a low surface energy polycarbonate binder or a blended binder consisting of a low surface energy polycarbonate and a film forming polycarbonate in any predetermined ratio that gives desirable degree of surface slipperiness to meet each xerographic machine need. In these embodiments, all the triple layers are comprised of about the same thickness, the same diamine m-TBD and polymer binder composition matrix, the same amount of a plasticizing liquid 26 addition of from about 3 to about 30 weight percent or between about 5 and about 12 weight percent with respect to the total weight of each respective layer. In the extension of these same additional embodiments, the plasticizer selected for all the triple CTLs incorporation is a fluoroketone 28.

In yet further extension of these very same embodiments, the formulations of these plasticized triple CTLs (comprising about the same thickness, the same diamine m-TBD and polymer binder composition matrix, the exact same amount of plasticizer addition of from about 3 to about 30 weight percent or between about 5 and about 12 weight percent with respect to the total weight of each respective layer, and the slippery top outermost exposed layer 20T containing a low surface energy polycarbonate binder or a blended binder consisting of a low surface energy polycarbonate and a film forming polycarbonate in any predetermined ratio that gives desirable degree of surface slipperiness to meet each xerographic machine need) are slightly altered such that the bottom layer and the center layer are both plasticized with a liquid 26, whereas that used in the slippery top outermost exposed layer 20T is a fluoroketone 28 to synergistically complement the low surface polycarbonate binder for maximizing the surface slipperiness effect.

In the modifications of all these exact same embodiments of slippery surface and curl-free imaging member of FIG. 5 disclosed above, the plasticized triple CTLs are also further re-formulated to comprise different amount of diamine m-TBD content, in descending order from bottom to the top layer, such that the bottom layer 20B has about 50 to about 80 weight percent, the center layer 20C has about 40 and about 70 weight percent, and the slippery top outermost exposed layer 20T has about 20 and about 60 weight percent diamine m-TBD for improving mechanical function.

Figure 6:
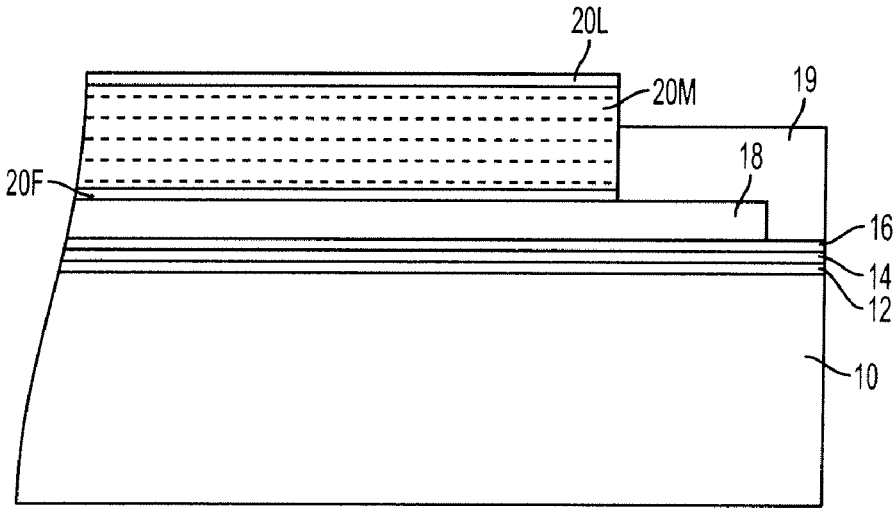
FIG. 6 is a cross-sectional view of a structurally simplified flexible multilayered electrophotographic imaging member having multiple charge transport layers according to an embodiment of the present disclosure.

In the innovative embodiments, the slippery surface and curl-free imaging member of present disclosure shown in FIG. 6, multiple CTLs of having from about 4 to about 10 discrete layers or between about 4 and about 6 discrete layers are designed; they consist of a bottom (first) layer 20F, multiple (intermediate) layers 20M, and a last (slippery top outermost) layer 20L containing a low surface energy polycarbonate binder or a blended binder consisting of a low surface energy polycarbonate and a film forming polycarbonate in any predetermined ratio to give intended degree of surface slipperiness. All the multiple layers are formed to comprise of about the same thickness, the same diamine m-TBD and polymer binder composition matrix (that is between about 30 and about 70 weight percent of (m-TBD) to between about 70 and about 30 weight percent of polymer binder), and the same amount of a plasticizer liquid 26 incorporation of from about 3 to about 30 weight percent or between about 5 and about 12 weight percent with respect to the total weight of each respective layer. In the extension of these innovative embodiments, the slippery surface and curl-free imaging member having the disclosed multiple CTLs is again formulated such that the last (slippery top outermost exposed) layer 20L contains a low surface energy polycarbonate binder or a blended binder consisting of a low surface energy polycarbonate and a film forming polycarbonate in any predetermined ratio to give intended degree of surface slipperiness, and with all the multiple layers comprise of about the same thickness, the same diamine m-TBD and polymer binder composition matrix (that is between about 30 and about 70 weight percent of (m-TBD) to between about 70 and about 30 weight percent of polymer binder), and the same amount of a plasticizer liquid incorporation of from about 3 to about 30 weight percent or between about 5 and about 12 weight percent with respect to the total weight of each respective layer. However, the plasticizer included in the bottom (first) layer 20F and the multiple (intermediate) layers 20M is liquid 26 while that used in the last (slippery top outermost) layer 20L is a fluoroketone 28 to maximize the surface slipperiness enhancement.

In the last modification of all these innovative embodiments of the slippery surface and curl-free imaging member of FIG. 6 according to the disclosure above, the multiple CTLs are further re-formulated to comprise of different amount of diamine m-TBD content, in a continuum of descending concentration gradient from bottom to the top layer, in such a fashion that the bottom (first) layer 20F has the greatest and a last (slippery top outermost) layer 20L contains the least. That is the first layer 20F has about 50 to about 80 weight percent, the average in the multiple (intermediate) layers 20M is about 40 to about 80 weight percent, and the last (slippery top outermost) layer 20L has about 20 and about 40 weight percent diamine m-TBD to impact greater CTL mechanical function and preserve the crucial photoelectrical integrity of the imaging member as well.

In the alternative embodiments, the disclosed slippery surface and curl-free imaging member, shown in FIG. 6, are re-created such that all the structural dimensions and material compositions of all the multiple CTLs are maintained identically to those described in the preceding, but with the exception that the single component plasticizer present in these multiple layers is alternatively replaced with a mixture of equal parts of two different plasticizers. The binary plasticizer mixture is formed to give every possible variety of compositions, for example, by mixing each liquid 26 of Formulas (IA), (IIA), (III), (IV), (V), (VI), (VII), (1), (2), (3), (4), (5), (A), and (B) with a liquid 28 selected from each of the eight fluoroketones.

Figure 7:
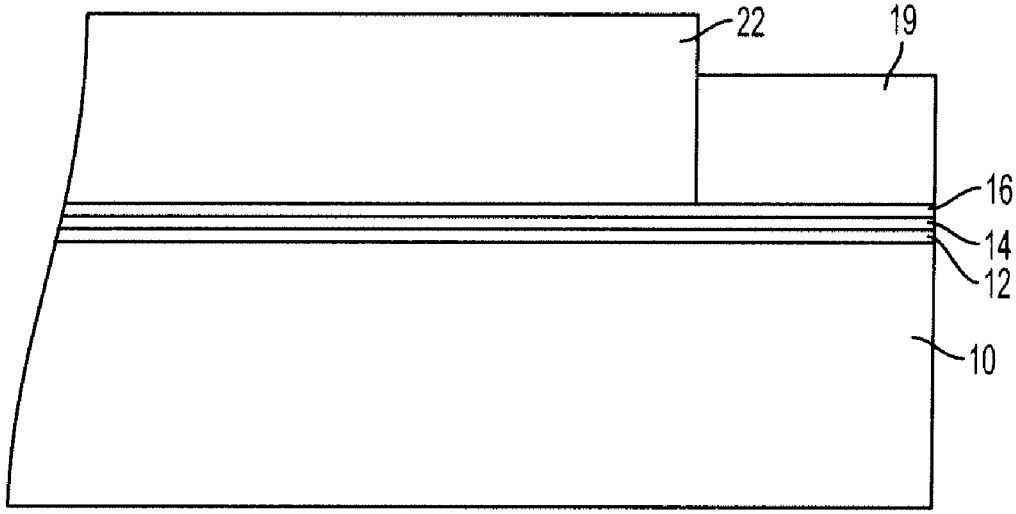
FIG. 7 is a cross-sectional view of a structurally simplified flexible multilayered electrophotographic imaging member having a single charge generating/transporting layer according to an alternative embodiment of the present disclosure.

As an alternative to the two discretely separated layers of being a CTL 20 and a CGL 18 as those described in FIG. 1, a structurally simplified slippery surface and curl-free imaging member according to the illustration in FIG. 7 is re-created. Although all other layers are being formed in the exact same manners and compositions like in the preceding figures, a single imaging layer 22 having both charge generating and charge transporting capabilities is utilized and also being plasticized by using the present disclosed plasticizers to reduce the internal stress/strain build-up for curl control without the need for an ACBC. As disclosed in the prior art, for example in U.S. Pat. No. 6,756,169, the single imaging layer 22 may comprise a single electrophotographically active layer capable of retaining an electrostatic charge in the dark during electrostatic charging, imagewise exposure, and image development. Nevertheless, the plasticized single imaging layer 22 of present disclosure may be formed to include charge transport molecules (the same to those of the CTL 20 according to the description in the preceding), may also optionally include a photogenerating/photoconductive material similar to those of the CGL 18 described above, plus the inclusion of a plasticizer, and also utilizing a low surface energy polycarbonate binder or a blended binder consisting of a low surface energy polycarbonate and a film forming polycarbonate in any predetermined ratio that gives desirable degree of surface slipperiness to meet each xerographic machine need. In exemplary embodiments, the plasticized single imaging layer 22 of the slippery surface and curl-free imaging member of the present disclosure is plasticized by using a single plasticizer liquid 26 which is selected from one of Formulas (IA), (IIA), (III), (IV), (V), (VI), (VII), (1), (2), (3), (4), (5), (A), and (B). The amount of the single component plasticizer incorporation into the layer is from about 3 to about 30 weight percent or between about 5 and about 12 weight percent with respect to the total weight of the single layer 22.

In another exemplary embodiments, the plasticized single imaging layer 22 of the disclosed slippery surface and curl-free imaging member is plasticized with a liquid 28 selected from each of the eight listed fluoroketones in previous embodiments to synergistically complement the low surface polycarbonate binder for maximizing the surface slipperiness effect.

In yet another exemplary embodiments, the plasticized single imaging layer 22 of the disclosed slippery surface and curl-free imaging member is plasticized with the use of a plasticizer mixture consisting of equal parts of the two different plasticizer categories. That is the binary plasticizer mixture is formed to give every possible variety of compositions, for example, by mixing each liquid 26 of Formulas (IA), (IIA), (III), (IV), (V), (VI), (VII), (1), (2), (3), (4), (5), (A), and (B) with a liquid 28 selected from each of the eight fluoroketones.

It is important to emphasize that the organic phthalates, monomeric bisphenol carbonates, and fluoro-containing organic liquids, selected for use as a single plasticizer incorporation or a binary mixture of plasticizers in all the preceding embodiments to meet the present low surface energy CTL re-formulation requirement for slippery surface and curl-free imaging member preparation, is based on the facts that these plasticizers are (a) each a high boiling compound with boiling point of at least 250° C. so their presence in the charge transport layer effects a plasticizing result which will be permanent and (b) they are totally miscible/compatible with the make-up compositions of the CTL such that their incorporation into the CTL material matrix should cause no deleterious impact to the photoelectrical function of the resulting imaging member.

Generally speaking, the thickness of the plasticized CTL (being a plasticized single layer, dual layers, or multiple layers) of all the slippery surface and curl-free flexible imaging members, are prepared according to FIGS. 2 to 7 disclosed above, and is in the range of from about 10 to about 100 micrometers, or between about 15 and about 50 micrometers. It is important to emphasize that the reasons the top outermost top layer of these imaging members employing compounded CTLs in the disclosure embodiments is formulated to comprise the least amount of diamine m-TBD charge transport molecules (in the descending concentration gradient from the bottom layer to the top layer) are to: (1) inhibit diamine m-TBD crystallization at the interface between two coating layers, (2) also to enhance the top layer's fatigue cracking resistance during dynamic machine belt cyclic function in the field, and (3) still yet able to maintain the desirably good photoelectrical properties to assure the resulting anticurl back coating-free imaging member belts properly function in the field.

The slippery surface and curl-free flexible imaging members of present disclosure, prepared to contain a plasticized charge transport layer or layers without the application of an ACBC, should have preserved the photoelectrical integrity with respect to each control imaging member. That means having charge acceptance ($V_0$) in a range of from about 750 to about 850 volts; sensitivity (S) sensitivity from about 250 to about 450 volts/ergs/cm$^2$; residual potential ($V_r$) less than about 50 volts; dark development potential (Vddp) of between about 280 and about 620 volts; and dark decay voltage (Vdd) of between about 50 and about 20 volts.

For typical conventional prior art ionographic imaging members used in an electrographic system, an electrically insulating dielectric imaging layer is applied to the electrically conductive surface. The substrate also contains an ACBC on the side opposite from the side bearing the electrically active layer to maintain imaging member flatness. In the present disclosure embodiments, the slippery surface and curl-free flexible ionographic imaging members may also conveniently be prepared without the need for an ACBC, through incorporating the dielectric imaging layer with the use of plasticizer(s) incorporation in a low surface energy polycarbonate according to the very same manners and descriptions demonstrated in the slippery surface and curl-free flexible electrophotographic imaging members preparation above.

To further improved the mechanical performance of the disclosed slippery surface and curl-free flexible imaging member design, the plasticized top CTL or the single imaging layer may also include the additive of inorganic or organic fillers to impart and/or enhance greater wear resistance. Inorganic fillers may include, but are not limited to, silica, metal oxides, metal carbonate, metal silicates, and the like, and mixtures thereof. Examples of organic fillers include, but are not limited to, KEVLAR, stearates, fluorocarbon (PTFE) polymers such as POLYMIST and ZONYL, waxy polyethylene such as ACUMIST and ACRAWAX, fatty amides such as PETRAC erucamide, oleamide, and stearamide, and the like. Either micron-sized or nano-sized inorganic or organic particles can be used in the fillers to achieve mechanical property reinforcement. The CTL may also contain a light shock resisting or reducing agent of from about 1 to about 6 wt-%. Such light shock resisting agents include 3,3',5,5'-tetra (t-butyl)-4,4'-diphenoquinone (DPQ); 5,6,11,12-tetraphenyl naphthacene (Rubrene); 2,2'-[cyclohexylidenebis[(2-methyl-4,1-phenylene)azo]]bis[4-cyclohexyl-(9Cl)]; perinones; perylenes; and dibromo anthanthrone (DBA).

The slippery surface and curl-free flexible multilayered electrophotographic imaging members, thus fabricated in accordance to all the above embodiments of present disclosure, may be cut into rectangular sheets. A pair of opposite ends of each imaging member cut sheet is then brought overlapped together thereof and joined by any suitable means, such as ultrasonic welding, gluing, taping, stapling, or pressure and heat fusing to form a continuous imaging member seamed belt, sleeve, or cylinder.

A prepared slippery surface and curl-free flexible imaging belt may thus thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

Furthermore, a prepared slippery surface and curl-free flexible electrophotographic imaging member belt can additionally be evaluated by printing in a marking engine into which the belt, formed according to the exemplary embodiments, has been installed. For intrinsic electrical properties it can also be determined by conventional electrical drum scanners. Additionally, the assessment of its propensity of developing streak line defects print out in copies can alternatively be carried out by using electrical analyzing techniques, such as those disclosed in U.S. Pat. Nos. 5,703,487; 5,697,024; 6,008,653; 6,119,536; and 6,150,824, which are incorporated herein in their entireties by reference. All the patents and applications referred to herein are hereby specifically, and totally incorporated herein by reference in their entirety in the instant specification.

All the exemplary embodiments encompassed herein include a method of imaging which includes generating an electrostatic latent image on a slippery surface and curl-free flexible imaging member, developing a latent image, and transferring the developed electrostatic image to a suitable receiving substrate.

The development of the presently disclosed embodiments will further be demonstrated in the non-limiting Working Examples below. They are, therefore in all respects, to be considered as illustrative and not restrictive nor limited to the materials, conditions, process parameters, and the like recited herein. The scope of embodiments are being indicated by the appended claims rather than the foregoing description. All changes that come within the meaning of and range of equivalency of the claims are intended to be embraced therein. All proportions are by weight unless otherwise indicated. It will be apparent, however, that the present embodiments can be practiced with many types of compositions and can have many different uses in accordance with the disclosure above and as pointed out hereinafter.

EXAMPLES

Low Surface Energy Polymer Coating Preparation

Two low surface energy bisphenol A polycarbonate coating solutions were prepared in the lab for coating layer quality evaluation.

The first coating solution was prepared by dissolving a pre-determined amount of a low surface energy polycarbonate LEXAN EXL1414T in methylene chloride solvent to give a 15 weight percent solid coating solution. The second coating was also prepared in the exact same procedures to give a 15 weight percent solid coating solution that contained a novel low surface energy bisphenol A polycarbonate LEXAN EXL 1463C.

Both the LEXAN EXL 1414T and EXL 1463C are A-B di-block copolymer commercially available from Sabic Innovative Plastics; both have a molecular weight of about 25,000 and also have exact same molecular structure as represented by the formula below:

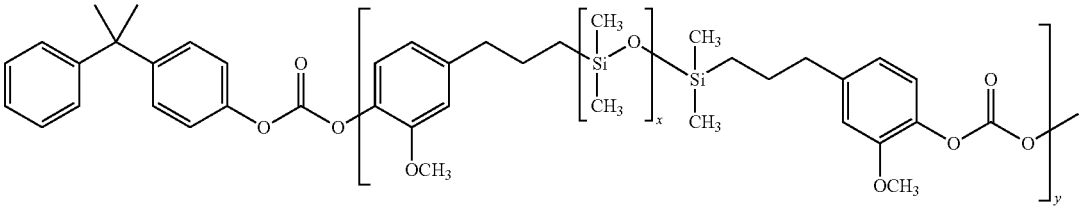

Block (A)

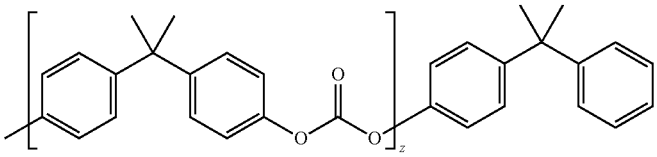

Block (B)

Even though both EXL1414T and EXL1463C do contain exact same 6 weight percent block (A) in each polymer backbone, based on the molecular weight of the low surface energy bisphenol A polycarbonate, as available from Sabic Plastics, nonetheless EXL1463C is an improved product over EXL1414T. The EXL1463C is designed with the intention to include one distinctively different feature apart from the EXL1414T through the reduction of the chain length of low surface energy polydimethyl siloxane (PDMS) repeat unit in block (A) segment of the polymer; that is by making the x value of 26 in the EXL 1463C, the PDMS repeating unit present in this low surface energy polycarbonate is, by comparison, a shorter chain of only about half the x value 50 in the EXL 1414T. Therefore from theoretical point of view, cutting the PDMS chain length to half in the EXL1463C should be the key to negate/offset the refractive index mismatch impact between the PDMS units and the polycarbonate main chain to thereby eliminate the light scattering effect (as observed in the EXL1414T layer) and give optically clear EXL 14163C coating layer. To establish the theoretical verification/assurance, experimental demonstration was then carried out as follows.

The two prepared coating solutions were each applied over a glass plate, using a 5 mil-gap draw bar, by following the standard hand coating procedure. The wet coating of each solution was dried at 120° C. in an air circulating oven for 2 minutes to give a 25 micrometer thickness dried layer. By naked eyes examination, the dried coating layer thus obtained for the EXL1463C was optically clear, whereas that of the EXL1414T counterpart was slightly hazy. The observed haziness in the EXL1414T coating layer was due to the fact of refractive index mismatch between the PDMS units in the polycarbonate main chain to cause light scattering problem. Therefore, the shortening of PDMS chain length, designed to have less repeating units in the low surface energy EXL1463C polycarbonate, the light scattering was then effectively eliminated to give an optically clear coating layer.

Control Example I

Single Charge Transport Layer Imaging Member Preparation

A conventional prior art flexible electrophotographic imaging member web was prepared by providing a 0.02 micrometer thick titanium layer coated substrate of a biaxially oriented polyethylene naphthalate substrate (PEN, available as KADALEX from DuPont Teijin Films) having a thickness of 4.2 mils. The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer had an average dry thickness of 0.04 micrometer as measured with an ellipsometer.

An adhesive interface layer was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

The adhesive interface layer was thereafter coated over with a CGL. The charge generating layer dispersion was prepared by adding 0.45 gram of IUPILON 200, a polycarbonate of poly(4,4'-diphenyl)-1,1'-cyclohexane carbonate (PCZ 200, available from Mitsubishi Gas Chemical Corporation), and 50 milliliters of tetrahydrofuran into a 4 ounce glass bottle. 2.4 grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 mil. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. This CGL comprised of poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometers.

This coated web was simultaneously coated over with a charge transport layer (CTL) and a ground strip layer by co-extrusion of the coating materials. The CTL was prepared by introducing into an amber glass bottle in a weight ratio of 1:1 (or 50 weight percent of each) of a bisphenol A polycarbonate thermoplastic (FPC 0170, having a molecular weight of about 120,000 and commercially available from Mitsubishi Chemicals) and a charge transport compound of N,N'-diphenyl-N,N'-bis(3-methylphenyl)-1,1'-biphenyl-4,4'-diamine.

The resulting mixture was dissolved to give 15 percent by weight solid in methylene chloride. This solution was applied on the CGL by extrusion to form a coating which after drying in a forced air oven gave a dry CTL 29 micrometers thick comprising 50:50 weight ratio of diamine transport charge transport compound to FPC0170 bisphenol A polycarbonate binder. The imaging member web, at this point if unrestrained, would curl upwardly into a 1¾-inch tube.

The strip, about 10 millimeters wide, of the adhesive layer left uncoated by the charge generator layer, was coated with a ground strip layer during the co-extrusion process. The ground strip layer coating mixture was prepared by combining 23.81 grams of polycarbonate resin (FPC 0170, available from Mitsubishi Chemicals) having 7.87 percent by total weight solids and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL, to the electrophotographic imaging member web to form an electrically conductive ground strip layer having a dried thickness of about 19 micrometers.

The imaging member web containing all of the above layers was then passed through 125° C. a forced air oven to dry the co-extrusion coated ground strip and CTL simultaneously to give respective 19 micrometers and 29 micrometers in dried thicknesses. At this point, the imaging member, having all the dried coating layers, would spontaneously curl upwardly into a 1½-inch roll when unrestrained as the web was cooled down to room ambient of 25° C. Since the CTL, having a glass transition temperature (Tg) of 85° C. and a coefficient of thermal contraction of about $6.6\times10^{-5}$/° C., it had about 3.7 times greater dimensional contraction than that of the PEN substrate having lesser a thermal contraction of about $1.9\times10^{-5}$/° C. Therefore, according to equation (1), a 2.75% internal strain was built-up in the 29 micrometer thick CTL to result in imaging member upward curling. The prepared imaging member web, same as that shown in FIG. 1 but without the application of an ACBC, had a curl-up diameter of 1¾-inch curvature was used to serve as control.

Disclosure Example I

EXL1463C Slippery/Plasticized Single CTL

Three sets of two slippery surface and curl-free flexible electrophotographic imaging member webs in each, without ACBC, were prepared using the very same material compositions and following identical procedures as those described in Control Example I, but with the exception that: (a) 10 and 25% wt of the bisphenol A polycarbonate binder in the CTL were replaced with LEXAN EXL1463C low surface energy polycarbonate from each respective single CTL of the imaging member webs of the three sets of these six imaging member webs; (b) 8 weight percent of diethyl phthalate (DEP) plasticizing liquid 26 (like that of FIG. 2A) was also incorporated in this single CTL of the first set of the two imaging member webs, based on the total weight of each CTL; (c) 8 weight percent of a monomeric bisphenol A carbonate (HIRI) plasticizing liquid 26 (like that of FIG. 2A) was also incorporated in this single CTL of the second set of the two imaging member webs, based on the total weight of each CTL; and (d) 8 weight percent of a fluoroketone plasticizing liquid 28 (like that of FIG. 2B) was incorporated in the single CTL of the third set of the remaining imaging member webs, based on the total weight of each CTL.

The diethyl phthalate (DEP) plasticizing liquid 26, available from Sigma-Aldrich Corporation, used for addition into the CTL has Formula (II) and is presented below:

Formula (II)

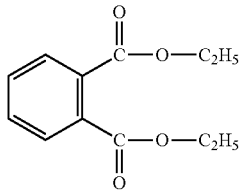

whereas, the monomeric bisphenol A (HIRI) liquid, available form PPG Chemicals, has a molecular structure as shown:

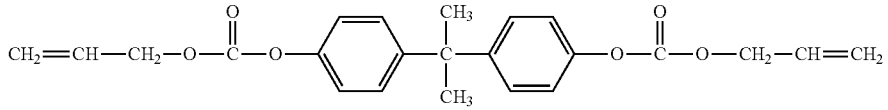

and the selected fluoroketone plasticizing liquid 28, available from Tokyo Kasei Kogyo Co. Inc., is 3-(trifluoromethyl) phenylacetone as represented by:

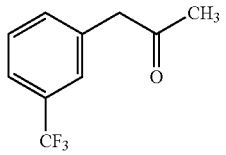

EXL1414T Slippery/Plasticized Single CTL

The preparation of additional three sets of two slippery surface and curl-free flexible electrophotographic imaging member webs in each, without ACBC, were once more repeated by using the very exact same material compositions and following identical procedures as described, but with the exception that the low surface energy polymer EXL1463C in the single layer CTL was substituted with EXL 1414T.

All the resulting imaging member webs, containing low surface energy polycarbonate EXL1463C and EXL1414T blended binder plus the inclusion of either a DEP or a fluoroketone plasticizing liquid in the CTL to eliminate internal stress/strain build-up for curl control, were successfully prepared according to the demonstrated disclosures described above. These imaging member webs, having no ACBC application, were flat and had a very slippery surface.

Control Example II

Dual Charge Transport Layers Imaging Member Preparation

A typical dual layered CTL flexible electrophotographic imaging member web was prepared by using the exact same materials, composition, and following identical procedures as those describe in the Control Example I, except that the single CTL was prepared to have dual layers: a bottom layer and a top exposed layer with each having 14.5 micrometers in thickness; and the bottom layer contains 50:50 weight ratio of diamine charge transport compound to polycarbonate binder while the weight ratio of which in the top layer was 30:50. Since the application of an ACBC was omitted, the prepared imaging member web, same as shown in FIG. 4, had spontaneously curled upwardly into a 1¾-inch roll after completion of the dual CTLs application.

Disclosure Example II

Slippery/Plasticized Dual CTLs Imaging Member Preparation

A slippery surface and curl-free then prepared with the exact same material composition and following identical procedures as those described in Control Example II, but with the exception that: (a) both these dual CTLs were plasticized with exact same 8 weight percent DEP liquid 26 to relive the internal stress/strain, based on the total weight of each CTL, to effect curl elimination and (b) 25% wt of the bisphenol A polycarbonate binder in the top exposed CTL of this imaging member web was replaced with the low surface energy polycarbonate LEXAN EXL1463C to render surface slipperiness for contact friction reduction.

Physical/Mechanical/Photoelectrical Properties Assessment

The flexible electrophotographic imaging members of Control Example I and the slippery surface and Curl-free Imaging members of Disclosure Examples were first determined for physical and mechanical properties, such as CTL surface energy, surface contact friction, abhesiveness, and imaging member flatness. The determinations were carried out by liquid wetting/contact angle measurement method for surface energy; contact friction against a polyurethane cleaning blade's sliding action for lubricity/slipperiness, 180° 3M adhesive tape peel-off strength for propensity of surface filming development, and flatness assessment by flatness determination. The results obtained are tabulated in the Tables 1, 2, and 3 below:

TABLE 1

| 8% DEP Plasticized CTL | | | | |
|---|---|---|---|---|
| Type of CTL Formulation | Surface Energy (dynes/cm) | Coefficient of Friction | Peel Strength (gm/cm) | Curl Diameter (inch) |
| Standard Control | 40 | 2.48 | 240 | 1¾ |
| 10%: 1463C/1414T | 25/28 | 0.78/0.81 | 31/37 | flat |
| 25%: 1463C/1414T | 23/28 | 0.76/0.81 | 30/37 | flat |

TABLE 2

| 8% HIRI Plasticized CTL | | | | |
|---|---|---|---|---|
| Type of CTL Formulation | Surface Energy (dynes/cm) | Coefficient of Friction | Peel Strength (gm/cm) | Curl Diameter (inch) |
| Standard Control | 40 | 2.48 | 240 | 1¾ |
| 10%: 1463C/1414T | 25/28 | 0.77/0.81 | 30/37 | flat |
| 25%: 1463C/1414T | 23/28 | 0.75/0.81 | 30/37 | flat |

TABLE 3

| 8% Fluoroketone Plasticized CTL | | | | |
|---|---|---|---|---|
| Type of CTL Formulation | Surface Energy (dynes/cm) | Coefficient of Friction | Peel Strength (gm/cm) | Curl Diameter (inch) |
| Standard Control | 40 | 2.48 | 240 | 1¾ |
| 10%: 1463C/1414T | 22/25 | 0.75/0.78 | 29/35 | flat |
| 25%: 1463C/1414T | 20/27 | 0.73/0.76 | 28/34 | flat |

The results listed in the above tables indicate that slippery surface and curl-free imaging members of Disclosure Example, comprising CTLs reformulated to: (a) incorporate the novel low surface energy LEXAN EXL1363C and EXL1414T polycarbonates and (b) include a liquid plasticizer in the CTL according to the present disclosure, did provide the overall physical/mechanical properties improvement and effective curl elimination over those seen in the STD CTL control counterpart. For 8 weight percent plasticized CTL, inclusion of a fluoroketone could provide an added benefit to give substantial surface energy reduction outcome than the use of DEP or HIRI; this is due to the fact that fluoroketone is by itself an intrinsically low surface energy liquid that could synergistically complement the low surface polycarbonate EXL 14643 or 1414T binder for maximizing the CTL surface slipperiness effect. In summary, the resulting CTLs comprised of a plasticizer and a low surface energy polycarbonate incorporation had low surface energy, low coefficient of friction, and good surface release. Therefore, the surface abhesiveness (opposite to adhesiveness), as seen in reduction in tape peel strength, is a positively indication to insure that the CTL should have: low propensity of surface filming development, increased abrasion/wear resistance, improved the efficiency of toner image transfer to paper, and eased the cleaning blade action for dirt/debris removal from the imaging member belt surface during xerographic imaging processes. Additionally, the slippery and plasticized CTLs in the imaging members of Disclosure Example adhered well to the charge generating layer and gave about equivalent bonding strength as that seen in the CTL of the STD Control Example. Since the experimental results obtained for the imaging member prepared to comprise slippery and plasticized dual CTLs were practically the same as those of single CTL, the data presentation is therefore omitted.

The slippery surface and curl-free imaging members were further assessed for each respective photo-electrical function. Photo-electrical property assessment was conducted, using a 4000 scanner, to assure that the overall photoelectrical integrity of each of the disclosure imaging members, as presented in Table 4 below, was not altered due to the addition of a plasticizer and incorporation/replacement of the film forming FPC polymer binder in the CTL with a low surface energy polycarbonate.

TABLE 4

| CTL Formulation | DEP (%) | HIRI (%) | Ketone (%) | Vo | S | Vc | Vr | Vddp |
|---|---|---|---|---|---|---|---|---|
| Photo-electrical Properties | | | | | | | | |
| Standard Control | none | none | none | 799 | 370 | 170 | 43 | 30 |
| 10% EXL1463C | 8 | none | none | 799 | 380 | 180 | 45 | 29 |
| 25% EXL1463C | 8 | none | none | 799 | 360 | 166 | 40 | 27 |
| 10% EXL1463C | none | 8 | none | 799 | 368 | 174 | 42 | 30 |
| 25% EXL1463C | none | 8 | none | 799 | 363 | 160 | 41 | 29 |
| 10% EXL1463C | none | none | 8 | 799 | 350 | 150 | 36 | 30 |
| 25% EXL1463C | none | none | 8 | 799 | 356 | 150 | 23 | 29 |
| After 10K fatigue cycles | | | | | | | | |
| Standard Control | none | none | none | 799 | 377 | 197 | 86 | 33 |
| 10% EXL1463C | 8 | none | none | 799 | 374 | 204 | 90 | 33 |
| 25% EXL1463C | 8 | none | none | 799 | 354 | 203 | 82 | 31 |
| 10% EXL1463C | none | 8 | none | 799 | 361 | 184 | 73 | 34 |
| 25% EXL1463C | none | 8 | none | 799 | 356 | 178 | 84 | 32 |
| 10% EXL1463C | none | none | 8 | 799 | 331 | 172 | 72 | 34 |
| 25% EXL1463C | none | none | 8 | 799 | 351 | 177 | 68 | 25 |

In recapitulation, the combination of use of a low surface energy film forming polycarbonate binder and a plasticizer in the CTL re-formulation, as demonstrated in the embodiments of present disclosure, of present disclosure has provided effective surface slipperiness to lower the surface contact friction for wear resistance enhancement and little or no internal stress/strain to eliminate imaging member curling issue, without affecting the photo-electrical function of the resulting slippery surface and curl-free imaging member.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents as would fall within the true scope and spirit of embodiments herein.

What is claimed is:

1. A flexible imaging member comprising:

a flexible substrate;

a charge generating layer disposed on the substrate; and at least one charge transport layer disposed on the charge generating layer, wherein the charge transport layer comprises a charge transport component molecularly dispersed in a low surface energy polycarbonate binder and at least one plasticizer, the low surface energy polymer binder being an A-B di-block copolymer comprising two segmental blocks, the first segment block (A) being

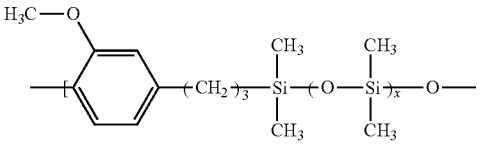

-continued

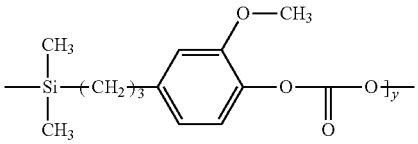

wherein x is 10 to 40, y is 1 to 15, and the second segment block (B) being selected from the group consisting of

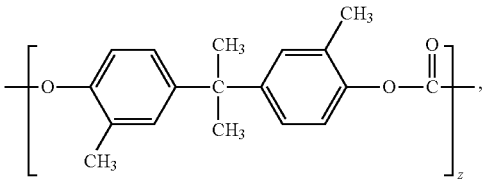

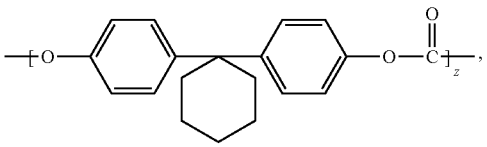

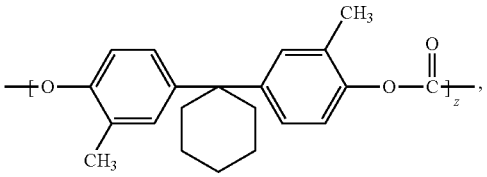

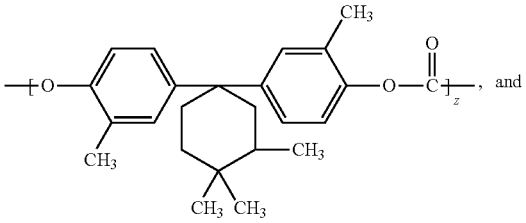

and

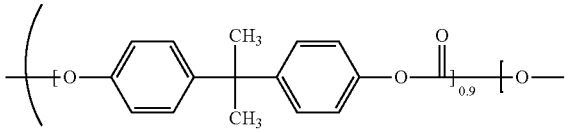

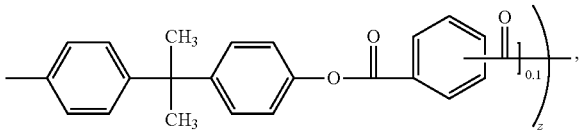

wherein z is 50 to 400.

2. The flexible imaging member of claim 1, wherein the low surface energy polycarbonate polymer is

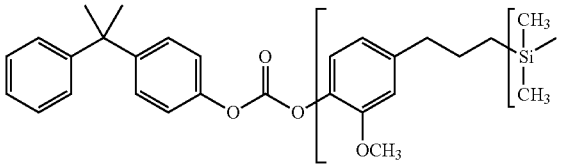

-continued

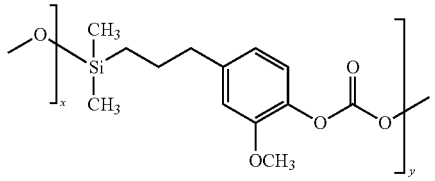

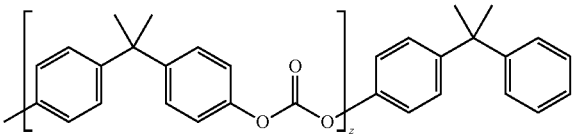

wherein x is 10 to 40, y is 1 to 15, and z is 50 to 400.

3. The flexible imaging member of claim 2, wherein x is 26.

4. The flexible imaging member of claim 1, wherein the plasticizer is selected from the group consisting of liquid phthalates, liquid monomeric bisphenol carbonates, oligomeric polystyrenes and fluoroketones.

5. The flexible imaging member of claim 4, wherein the liquid phthalates are selected from the group consisting of Formula (I)

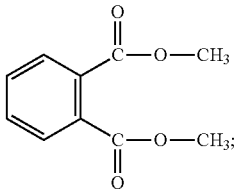

Formula (IA)

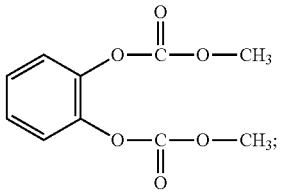

Formula (II)

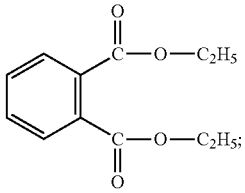

Formula (IIA)

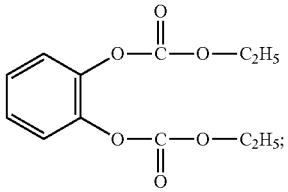

Formula (III)

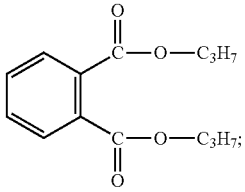

-continued

Formula (IV)

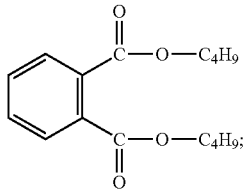

Formula (V)

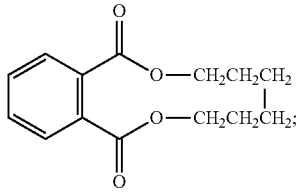

Formula (VI)

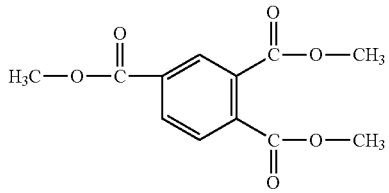

and

Formula (VII)

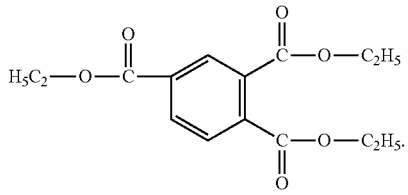

6. The flexible imaging member of claim 4, wherein the liquid monomeric bisphenol carbonates are selected from the group consisting of Formula (1)

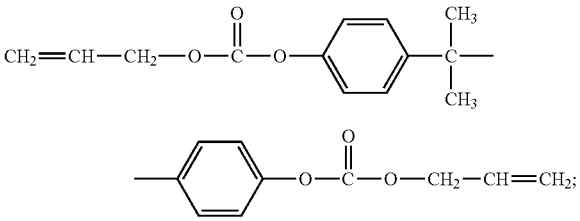

Formula (2)

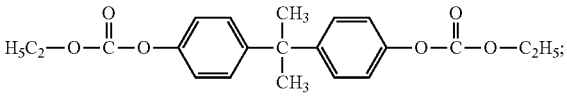

Formula (3)

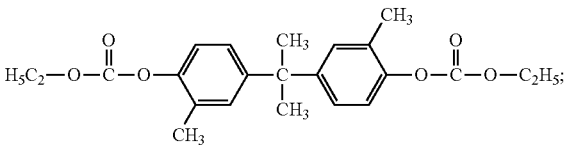

-continued

Formula (4)

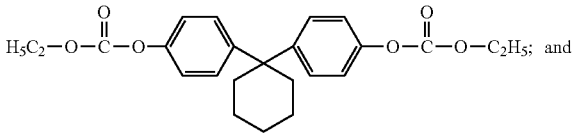

and

Formula (5)

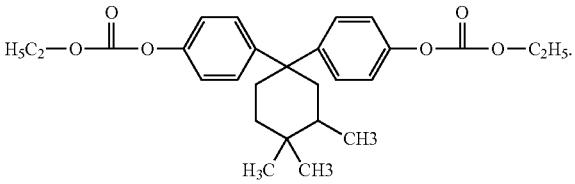

7. The flexible imaging member of claim 4, wherein the oligomeric polystyrenes are selected from the group consisting of Formula (A)

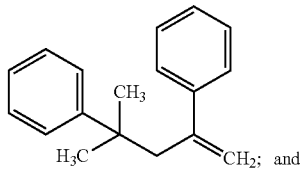

and

Formula (B)

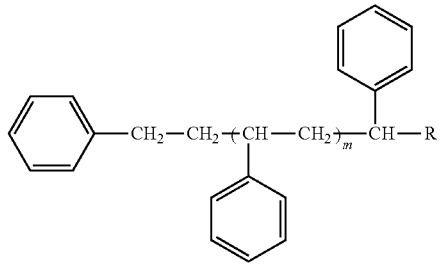

wherein R is selected from the group consisting of H, $CH_3$, $CH_2CH_3$, and $CH{=}CH_2$, and where m is between 0 and 3.

8. The flexible imaging member of claim 4, wherein the fluoroketones are selected from the group consisting of 3-(trifluoromethyl)phenylacetone, 2'-(trifluoromethyl)propiophenone, 2,2,2-trifluoro-2',4'-dimethoxyacetophenone, 3',5'-bis(trifluoromethyl)acetophenone, 3'-(trifluoromethyl)propiophenone, 4'-(trifluoromethyl)propiophenone, 4,4,4-trifluoro-1-phenyl-1,3-butanedione, and 4,4-difluoro-1-phenyl-1,3-butanedione, represented by the molecular structures shown below:

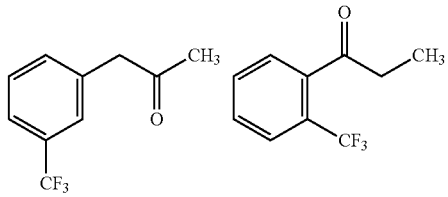

-continued

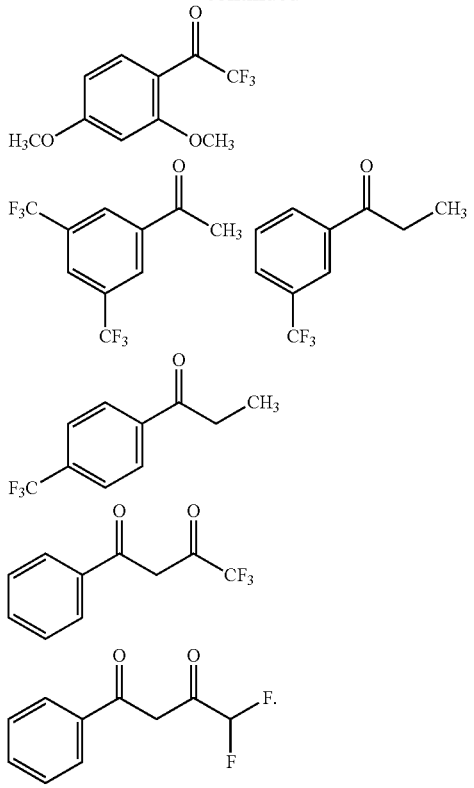

9. The flexible imaging member of claim 1, wherein the charge transport layer has a binary mixture of two plasticizers comprising an organic liquid mixed with a fluoroketone in a weight ratio between about 10:90 and about 90:10, the organic liquid being selected from the group consisting of a phthalate liquid, a monomeric bisphenol carbonate liquid, and an oligomeric polystyrene liquid.

10. The flexible imaging member of claim 1, wherein the low surface energy polycarbonate binder is present in the charge transport layer in an amount of from about 30 to about 70 percent by weight of the total weight of the charge transport layer.

11. The flexible imaging member of claim 10, wherein the binder in the charge transport layer is a polymer blended binder consisting of the low surface energy polycarbonate binder and a film forming bisphenol polycarbonate present in weight ratios of the low surface energy polycarbonate to the bisphenol polycarbonate of between about 10:90 and about 90:10 based on the combined weight of the low surface energy polycarbonate and the film forming bisphenol polycarbonate in the charge transport layer.

12. The flexible imaging member of claim 1, wherein the plasticizer is present in the charge transport layer in an amount of from about 3 to about 30 percent by weight of the total weight of the charge transport layer.

13. The flexible imaging member of claim 1, wherein the charge transport layer is a dual-layer including a bottom charge transport layer and a top exposed charge transport layer disposed on the bottom charge transport layer, and further wherein the top exposed charge transport layer comprises the low surface energy polycarbonate binder, the bottom layer comprises a film forming bisphenol polycarbonate binder, and with both dual layers contain the same amount of a plasticizer.

14. The flexible imaging member of claim 13, wherein the top exposed charge transport layer of the dual charge transport layers is comprised of a polymer blended binder consisting of the low surface energy polycarbonate binder and a film forming bisphenol polycarbonate present in weight ratios of the low surface energy polycarbonate to the bisphenol polycarbonate of between about 10:90 and about 90:10 based on the combined weight of the low surface energy polycarbonate and the film forming bispheol polycarbonate in the top exposed charge transport layer.

15. The flexible imaging member of claim 1, wherein the charge transport layer is a triple-layer including a bottom charge transport layer, a middle charge transport layer disposed on the bottom charge transport layer, and a top exposed charge transport layer disposed on the middle charge transport layer, and further wherein the top exposed charge transport layer comprises the low surface energy polycarbonate binder, the middle and bottom layers comprise a film forming bisphenol polycarbonate binder, and with all the triple layers contain the same amount of a plasticizer.

16. The flexible imaging member of claim 15, wherein the top exposed charge transport layer of these triple layers is comprised of a polymer blended binder consisting of the low surface energy polycarbonate binder and a film forming bisphenol polycarbonate present in weight ratios of the low surface energy polycarbonate to the bisphenol polycarbonate of between about 10:90 and about 90:10 based on the combined weight of the low surface energy polycarbonate and the film forming bisphenol polycarbonate in the top exposed charge transport layer.

17. The flexible imaging member of claim 1, wherein the charge transport layer comprises multiple layers including a bottom charge transport layer, a plurality of middle charge transport layers disposed on the bottom charge transport layer, and a top exposed charge transport layer disposed on the plurality of middle charge transport layers, and further wherein the top exposed charge transport layer comprises the low surface energy polycarbonate binder, the plurality of middle layers and the bottom layers comprise a film forming bisphenol polycarbonate binder, and with all the multiple charge transport layers contain the same amount of a plasticizer.

18. The flexible imaging member of claim 17, wherein the top exposed charge transport layer of the multiple layers is comprised of a polymer blended binder consisting of the low surface energy polycarbonate binder and a film forming bisphenol polycarbonate present in weight ratios of the low surface energy polycarbonate to the bisphenol polycarbonate of between about 10:90 and about 90:10 based on the combined weight of the low surface energy polycarbonate and the film forming bisphenol polycarbonate in the top exposed charge transport layer.

19. The flexible imaging member of claim 17, wherein the amount of charge transport compound present in the charge transport layers decreases from the bottom charge transport layer to the top exposed charge transport layer.

20. The flexible imaging member of claim 1, wherein a surface energy of the charge transport layer is from about 20 to about 28 dynes/cm.

21. The flexible imaging member of claim 1, wherein a coefficient of friction of the charge transport layer against the sliding action of a polyurethane cleaning blade is from about 0.73 to about 0.81.

22. The flexible imaging member of claim 1, wherein a 180° tape peel-off strength from the surface of the charge transport layer is from about 28 to about 37 gms/cm.

23. A flexible imaging member comprising:

a flexible substrate;

a charge generating layer disposed on the substrate; and at least one charge transport layer disposed on the charge generating layer, wherein the charge transport layer comprises a charge transport component molecularly dispersed in a low surface energy polycarbonate binder and at least one plasticizer, the low surface energy polymer binder being an A-B di-block copolymer comprising two segmental blocks, the first segment block (A) being

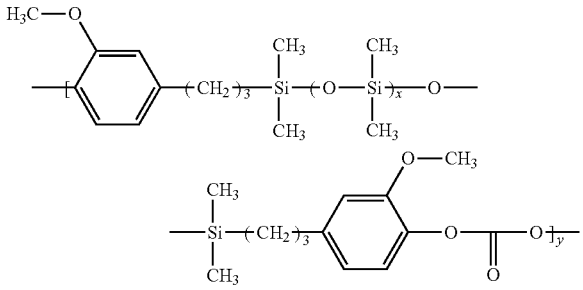

wherein x is 10 to 40, y is 1 to 15, and the second segment block (B) being selected from the group consisting of

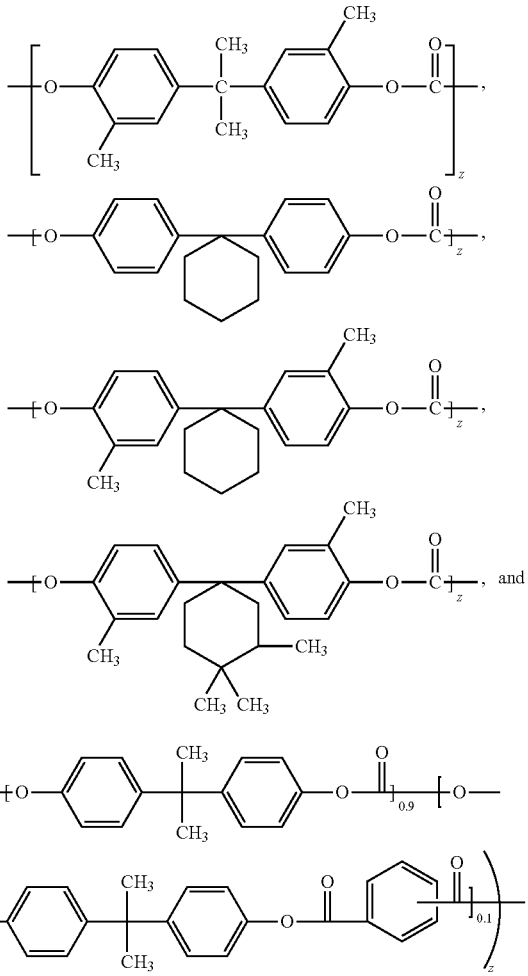

wherein z is 50 to 400, and the plasticizers being selected from the group consisting of liquid phthalates, liquid monomeric bisphenol carbonates, oligomeric polystyrenes and fluoroketones.

24. An image forming apparatus for forming images on a recording medium comprising:

a) a flexible imaging member having a charge retentive-surface for receiving an electrostatic latent image thereon, wherein the flexible imaging member comprises a flexible substrate;

a charge generating layer disposed on the substrate; and at least one charge transport layer disposed on the charge generating layer, wherein the charge transport layer comprises a charge transport component molecularly dispersed in a low surface energy polycarbonate binder and at least one plasticizer, the low surface energy polymer binder being an A-B di-block copolymer comprising two segmental blocks, the first segment block (A) being

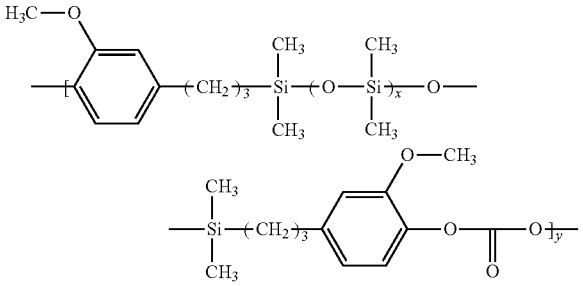

wherein x is 10 to 40, y is 1 to 15, and the second segment block (B) being selected from the group consisting of

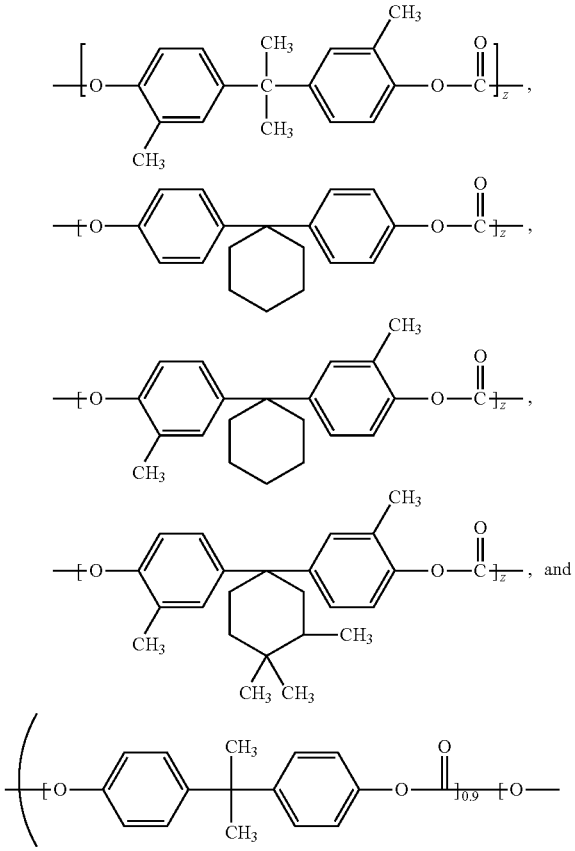

-continued

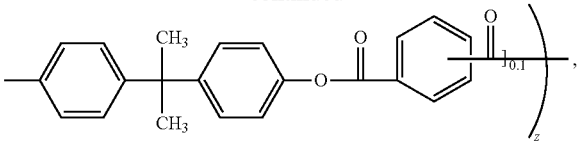

wherein z is 50 to 400, and the plasticizers being selected from the group consisting of liquid phthalates, liquid monomeric bisphenol carbonates, oligomeric polystyrenes and fluoroketones;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

* * * * *